US010441846B2

(12) United States Patent
Balan et al.

(10) Patent No.: US 10,441,846 B2
(45) Date of Patent: Oct. 15, 2019

(54) PORTABLE SINGLE BICEPS EXERCISING MACHINE

(71) Applicants: Alexey Balan, Van Nuys, CA (US); Tigran Petrosyan, Winnetka, CA (US)

(72) Inventors: Alexey Balan, Van Nuys, CA (US); Tigran Petrosyan, Winnetka, CA (US)

( * ) Notice: Subject to any disclaimer, the term of this patent is extended or adjusted under 35 U.S.C. 154(b) by 140 days.

(21) Appl. No.: 15/608,475

(22) Filed: May 30, 2017

(65) Prior Publication Data

US 2017/0340919 A1 Nov. 30, 2017

Related U.S. Application Data

(60) Provisional application No. 62/343,754, filed on May 31, 2016.

(51) Int. Cl.
*A63B 23/12* (2006.01)
*A63B 21/00* (2006.01)
(Continued)

(52) U.S. Cl.
CPC ..... *A63B 23/1281* (2013.01); *A63B 17/04* (2013.01); *A63B 21/00069* (2013.01);
(Continued)

(58) Field of Classification Search
CPC ..... A63B 21/0004; A63B 21/00043; A63B 21/00058; A63B 21/00061; A63B 21/00065; A63B 21/00072; A63B 21/00076; A63B 21/00178; A63B 21/00181; A63B 21/00185; A63B 21/002; A63B 21/0023; A63B 21/02; A63B 21/022; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/08; A63B 21/15; A63B 21/159; A63B 21/4001; A63B 21/4017; A63B 21/4019; A63B 21/4021; A63B 21/4023; A63B 21/4025;
(Continued)

(56) References Cited

U.S. PATENT DOCUMENTS 4,109,908 A 8/1978 Pugh
D251,313 S 3/1979 Jinotti
(Continued)

*Primary Examiner* — Gary D Urbiel Goldner
(74) *Attorney, Agent, or Firm* — Eric Kelly

(57) ABSTRACT

A portable single biceps exercising machine comprises an articulable framework running about a length of a user's arm. The articulable framework may be divided into an upper framework and a lower framework, with an articulable fulcrum connecting the upper framework to the lower framework. In use, the upper framework, at an under arm pad, may be retained in a shoulder/armpit region of the user's arm, while the lower framework may comprise a handle to be engaged by a hand of the user's arm. One or more tension members are coupled between the upper framework and the lower framework such that articulation of the handle about the articulable fulcrum towards the under arm pad is through a resistance. The resistance exercises a biceps muscle of the user's arm.

16 Claims, 29 Drawing Sheets

(51) Int. Cl.

| | |
|---|---|
| ***A63B 21/02*** | (2006.01) |
| ***A63B 17/04*** | (2006.01) |
| ***A63B 23/035*** | (2006.01) |
| ***A63B 21/055*** | (2006.01) |
| ***A63B 21/04*** | (2006.01) |
| ***A63B 21/045*** | (2006.01) |

(52) U.S. Cl.
CPC ..... *A63B 21/023* (2013.01); *A63B 21/4005* (2015.10); *A63B 21/4025* (2015.10); *A63B 21/4035* (2015.10); *A63B 21/4039* (2015.10); *A63B 21/4047* (2015.10); *A63B 23/03508* (2013.01); *A63B 21/00065* (2013.01); *A63B 21/0442* (2013.01); *A63B 21/0455* (2013.01); *A63B 21/0552* (2013.01); *A63B 2210/50* (2013.01); *A63B 2225/09* (2013.01)

(58) Field of Classification Search
CPC ..... A63B 21/4027; A63B 21/4033; A63B 21/4035; A63B 21/4039; A63B 21/4041; A63B 21/4045; A63B 21/4047; A63B 21/4049; A63B 23/035; A63B 23/03508; A63B 23/12; A63B 23/1281; A63B 69/0057; A63B 69/0059; A63B 71/0036; A63B 71/0054; A63B 2071/0063; A63B 2071/0072; A63B 2071/0081; A63B 2071/009; A63B 2210/00; A63B 2210/50; A63B 2225/09; A63B 2225/093
See application file for complete search history.

(56) References Cited

U.S. PATENT DOCUMENTS

| | | | | | |
|---|---|---|---|---|---|
| D255,136 | S | | 5/1980 | Brentham | |
| 4,254,953 | A | * | 3/1981 | Marchetti | A61F 5/013 473/214 |
| 4,433,679 | A | * | 2/1984 | Mauldin | A61F 5/0125 602/16 |
| 4,589,655 | A | | 5/1986 | Ammon | |
| 4,813,669 | A | | 3/1989 | Caruthers | |
| 4,822,027 | A | | 4/1989 | Kascak | |
| 4,880,228 | A | | 11/1989 | Caruthers | |
| 4,900,016 | A | | 2/1990 | Caruthers | |
| D313,637 | S | | 1/1991 | Pleasant | |
| 5,042,799 | A | | 8/1991 | Stanley | |
| 5,350,345 | A | | 9/1994 | Frey | |
| 5,413,546 | A | | 5/1995 | Basile | |
| D361,809 | S | | 8/1995 | Huang | |
| 5,454,769 | A | | 10/1995 | Chen | |
| 5,518,480 | A | | 5/1996 | Frappier | |
| 5,547,442 | A | * | 8/1996 | Carballosa | A63B 23/03533 482/123 |
| 5,759,138 | A | * | 6/1998 | Boland | A63B 23/0211 482/122 |
| 5,759,165 | A | | 6/1998 | Malewicz | |
| 5,951,499 | A | | 9/1999 | Saringer | |
| 5,964,685 | A | * | 10/1999 | Boland | A63B 23/0211 482/121 |
| 6,171,221 | B1 | | 1/2001 | Hayduk | |
| 6,179,799 | B1 | | 1/2001 | Doran | |
| D440,611 | S | | 4/2001 | Batca | |
| 6,241,643 | B1 | | 6/2001 | Loft | |
| 6,296,598 | B1 | | 10/2001 | Boland | |
| 6,340,341 | B1 | | 1/2002 | Purcell | |
| 6,497,640 | B2 | | 12/2002 | Loft | |
| 6,506,172 | B1 | | 1/2003 | Hepburn | |
| 6,565,493 | B1 | | 5/2003 | Geh | |
| 6,740,051 | B2 | | 5/2004 | Hepburn | |
| 6,921,352 | B1 | | 7/2005 | Stearns | |
| 6,976,940 | B2 | | 12/2005 | Schneider | |
| 7,270,643 | B2 | | 9/2007 | Pellinen | |
| 7,537,547 | B1 | | 5/2009 | Hosik | |
| 7,699,754 | B2 | | 4/2010 | Schneider | |
| D626,188 | S | | 10/2010 | Bisson | |
| 8,007,406 | B2 | | 8/2011 | Schneider | |
| 2002/0013201 | A1 | | 1/2002 | Loft | |
| 2003/0125651 | A1 | | 7/2003 | Hopkins | |
| 2003/0209248 | A1 | | 11/2003 | Berger | |
| 2004/0023763 | A1 | * | 2/2004 | Sleiman | A63B 23/129 482/126 |
| 2009/0111668 | A1 | * | 4/2009 | Fields, I | A63B 21/0552 482/124 |
| 2010/0144501 | A1 | * | 6/2010 | Berhanu | A63B 21/072 482/139 |
| 2011/0065553 | A1 | * | 3/2011 | Cersonsky | A63B 21/0004 482/114 |
| 2012/0264576 | A1 | * | 10/2012 | Goeckel | A63B 21/0004 482/124 |
| 2014/0094351 | A1 | * | 4/2014 | Cersonsky | A63B 21/0004 482/115 |
| 2014/0329644 | A1 | | 11/2014 | Richard | |
| 2015/0209607 | A1 | * | 7/2015 | Fields, I | A63B 21/008 482/112 |

* cited by examiner

PORTABLE SINGLE BICEPS EXERCISING MACHINE

PRIORITY NOTICE

The present application claims priority under 35 U.S.C. § 119(e) to U.S. Provisional Patent Application Ser. No. 62/343,754 filed on May 31, 2016, the disclosure of which is incorporated herein by reference in its entirety.

TECHNICAL FIELD OF THE INVENTION

The present invention relates in general to devices that for exercising arm muscles and more specifically to devices for predominantly exercising upper arm muscles, like biceps and where such devices are portable.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

There is a need in the art for an arm bicep exercise machine that is portable, easily usable, and easily storable. Other bicep exercise devices require the user to strap into the device, or they require other setup processes that consume time and interrupt the user's exercise routine. This reduces the quality of the exercise and this reduces a likelihood that the user will continue to use such devices. Some devices in the prior art are overly-cumbersome which minimizes device portability and storability. There is a need for a device is lightweight.

Further, there is need in the art for an arm bicep exercise machine that is effective. Other exercise devices that utilize different removable engagements with the user, or are not resistance-based exercise devices, also limit the range of possible exercise motion. As such, there is a need for a device that is resistance-based and that will allow the user to curl their entire arm, and with utilizing different wrist positions.

Moreover, there is a need in the art for a single device that can adapt to a user's various exercise movements and/or routines. Such a device or variations thereof would be ambidextrous, and would facilitate variations of the traditional curling exercise movement through differing grips and styles of handles, adjustable resistance means, and different types of resistance means. Also, there is a need for such a bicep exercise machine to be adjustable to accommodate different anatomical sizes and lengths of different user forearms and upper arms.

It is to these ends that the present invention has been developed.

BRIEF SUMMARY OF THE INVENTION

To minimize the limitations in the prior art, and to minimize other limitations that will be apparent upon reading and understanding the present specification, the present invention describes a portable single bicep exercising machine. The machine may comprise articulable framework running about a length of a user's given arm. This framework may be divided into upper framework and lower framework, with an articulable fulcrum connecting the upper framework to the lower framework. In use the upper framework, at an under arm pad, may be retained in a user's should/armpit region; while the lower framework may comprise a handle to be engaged by the user's hand of that same arm. Also between this upper framework and this lower framework may be one or more tension means, such that when the handle is articulated towards the under arm pad, about the fulcrum, that articulation is through resistance. It is such resistance that exercises the bicep of that same given arm. Different embodiments may use different types of handles. For example one type of handle may accommodate normal or traditional curl exercises, while another type of handle (referred to herein as a "short elongate member") may accommodate hammer type curls. And the user may perform curls with the machine with different wrist positions, such as pronated or supinated.

It is an objective of the present invention to provide the user with a portable exercise machine, such as a portable single bicep exercising machine.

It is another objective of the present invention that exercise movement effectively exercises the user's biceps.

It is another objective of the present invention to be simple to start and stop using, e.g., with minimal setup involved for the user.

It is another objective of the present invention to be smaller in size than other exercise machines and thus easier to store when not in use.

It is another objective of the present invention to provide the user with resistance-based exercise movements.

It is another objective of the present invention to exercise biceps on one arm at a time.

It is another objective of the present invention to provide the portable single bicep exercising machine that may operate on either of the user's arms.

It is another objective of the present invention to provide the portable single bicep exercising machine that is operable from a standing or a sitting position.

It is another objective of the present invention to provide the portable single bicep exercising machine that may operable with the user using different wrist positions exercising the biceps.

It is another objective of the present invention to allow different types of exercise movements, such as, but not limited to, curls, including hammer curls, to be performed with the portable single bicep exercising machine.

It is another objective of the present invention to be lightweight.

It is another objective of the present invention to have adjustable resistance means.

It is another objective of the present invention to have different types of resistance means.

It is another objective of the present invention to have detachable parts which can be easily cleaned thus minimizing the spread of germs and bacteria.

It is yet another objective of the present invention to promote comfortable user interaction while exercising.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

REFERENCE NUMERAL SCHEDULE

Figure 1A:
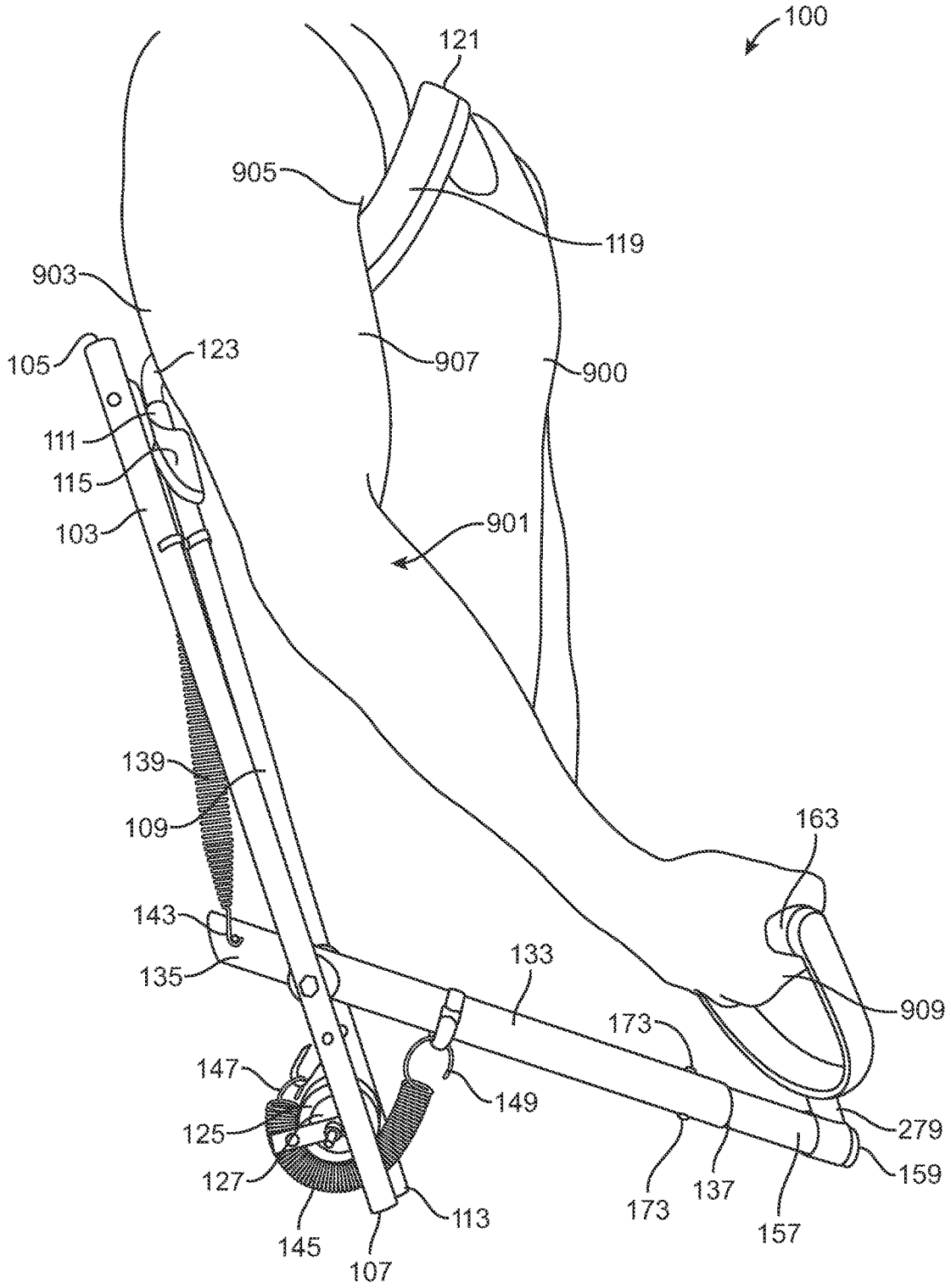
FIG. 1A may depict an embodiment of a portable bicep exercising machine in use with a user, depicted from a right side.

100 portable bicep exercising machine 100
103 first elongate member 103
105 upper terminal end 105
107 lower terminal end 107
109 second elongate member 109
111 second upper terminal end 111
113 second lower terminal end 113
115 tricep pad 115
117 upper crossbar 117
119 under-arm pad 119
121 upper-pad-terminal-end 121
123 lower-pad-terminal-end 123
125 pulley 125
127 first side 127 (of pulley 125)
131 lower crossbar 131
133 pivoting elongate member 133
135 closed terminal end 135
137 open terminal end 137
139 first tension means 139
141 upper end 141 (of first tension means 139)

143 lower end 143 (of first tension means 139)
145 second tension means 145
147 first end 147 (of second tension means 145)
149 second end 149 (of the second tension means 145)
157 inner extending elongate member 157
159 outer terminal end 159 (of inner extending elongate member 157)
161 enclosed terminal end 161 (of inner extending elongate member 157)
163 handle 163
173 spring-loaded-push-button 173
181 short elongate member 181
183 upper terminal cap 183 (of short elongate member 181)
185 lower terminal cap 185 (of short elongate member 181)
189 receiving-holes 189
200 portable bicep exercising machine 200
201 pivot-axle 201
229 second side 229 (of pulley 125)
251 third tension means 251
253 first-tension-end 253 (of third tension means 251)
255 second-tension-end 255 (of third tension means 251)
275 outer opposite terminal point 275 (of handle 163)
276 grip bar 276
277 inner opposite terminal point 277 (of handle 163)
279 lower terminal point 279 (of handle 163)
287 ball joint 287
295 receiving-cavity 295 (of elongate member 103/109)
302 bushing 302 (for minimizing friction)
317 set screw 317 (for setting location of upper crossbar 117)
326 pulley axle 326 (for pulley 125)
327 pulley bracket 327 (for pulley 125)
517 slot 517
518 stop 518
600 portable bicep exercising machine 600
663 linkage 663
665 linkage-receiver 665
900 user 900
901 arm 901
903 tricep 903
905 armpit 905
907 bicep 907
909 hand 909

DETAILED DESCRIPTION OF THE INVENTION

A portable single bicep exercising machine is disclosed. The machine may comprise articulable framework running about a length of a user's given arm. This framework may be divided into upper framework and lower framework, with an articulable fulcrum connecting the upper framework to the lower framework. In use the upper framework, at an under arm pad, may be retained in a user's should/armpit region; while the lower framework may comprise a handle to be engaged by the user's hand of that same arm. Also between this upper framework and this lower framework may be one or more tension means, such that when the handle is articulated towards the under arm pad, about the fulcrum, that articulation is through resistance. It is such resistance that exercises the bicep of that same given arm. Different embodiments may use different types of handles. For example one type of handle may accommodate normal or traditional curl exercises, while another type of handle (referred to herein as a "short elongate member") may accommodate hammer type curls. And the user may perform curls with the machine with different wrist positions, such as pronated or supinated.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Figure 1B:
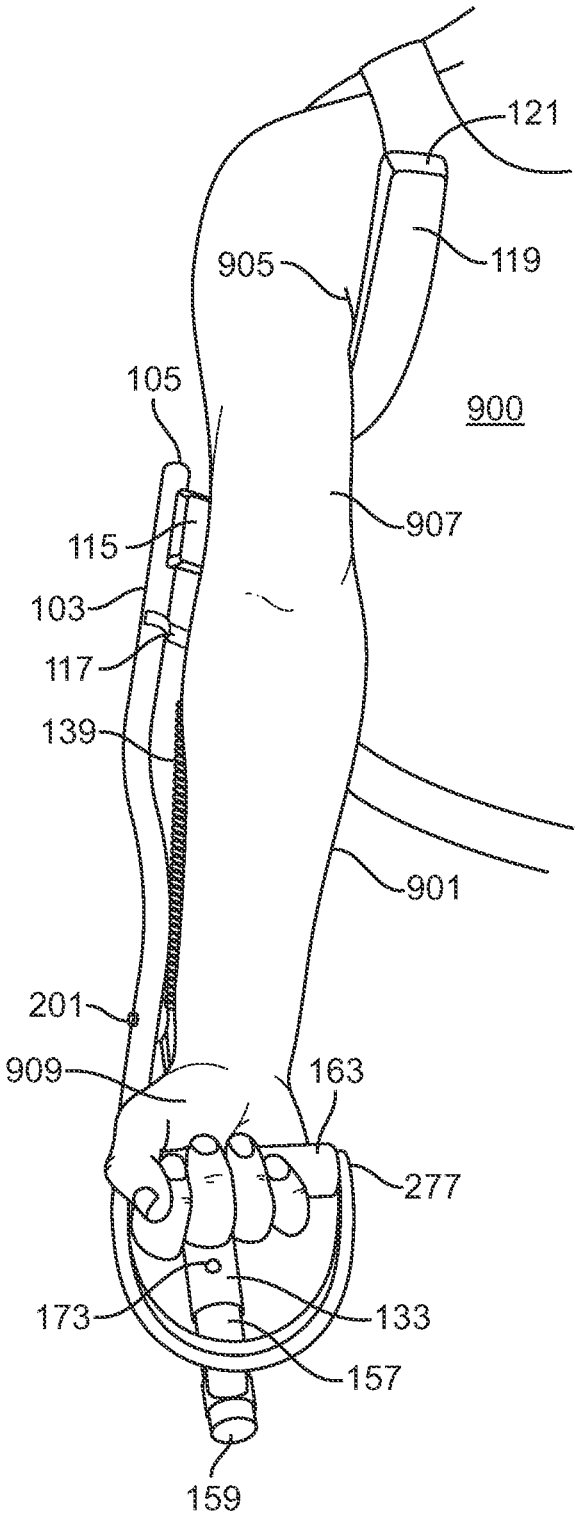
FIG. 1B may depict the embodiment of the portable bicep exercising machine in use with the user from FIG. 1A, but depicted from a right front side.
Figure 1C:
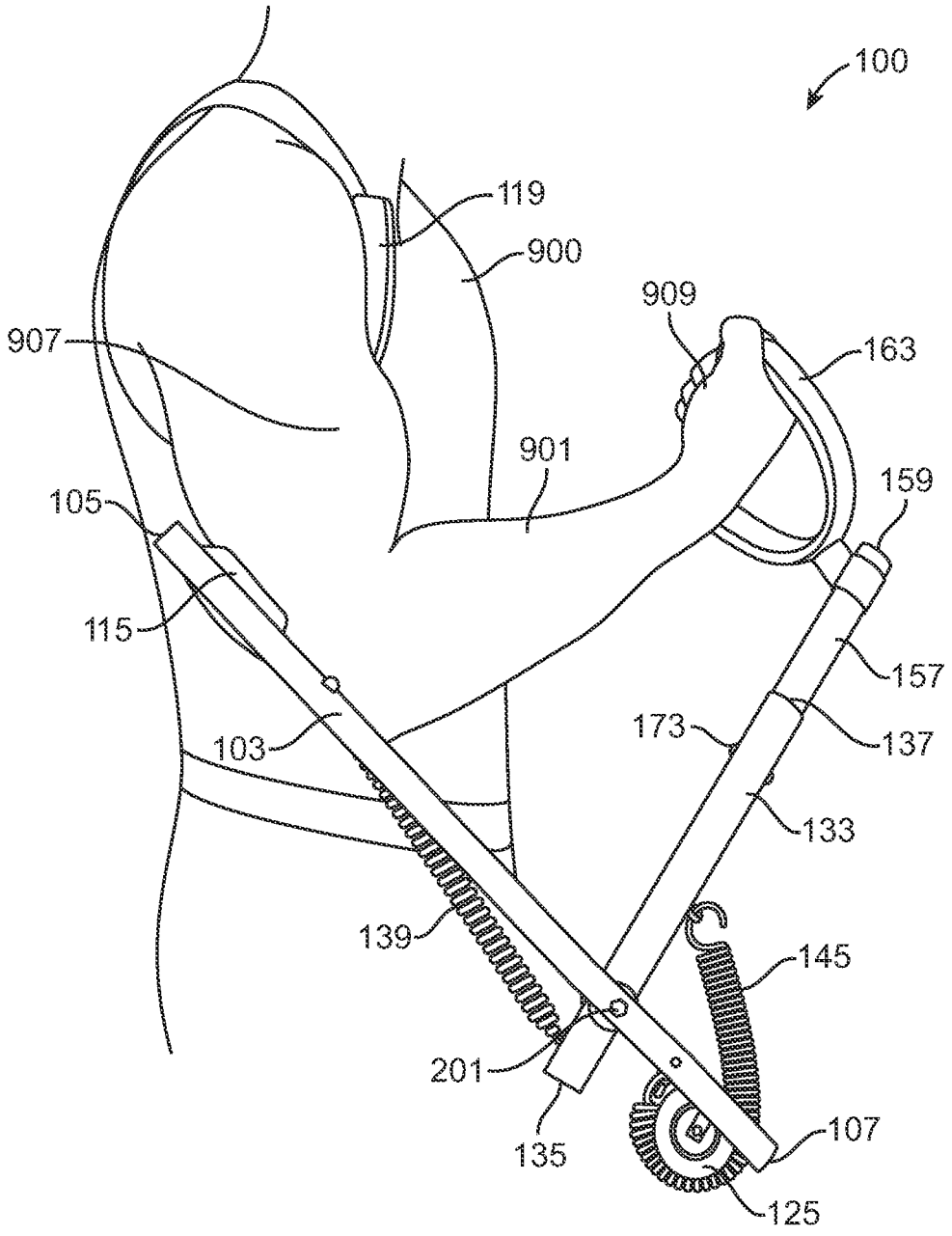
FIG. 1C may depict the embodiment of the portable bicep exercising machine in use with the user from FIG. 1A, but with the portable bicep exercising machine in a configuration where the user's bicep muscle is flexed, also shown from a similar right side view as FIG. 1A.
Figure 1D:
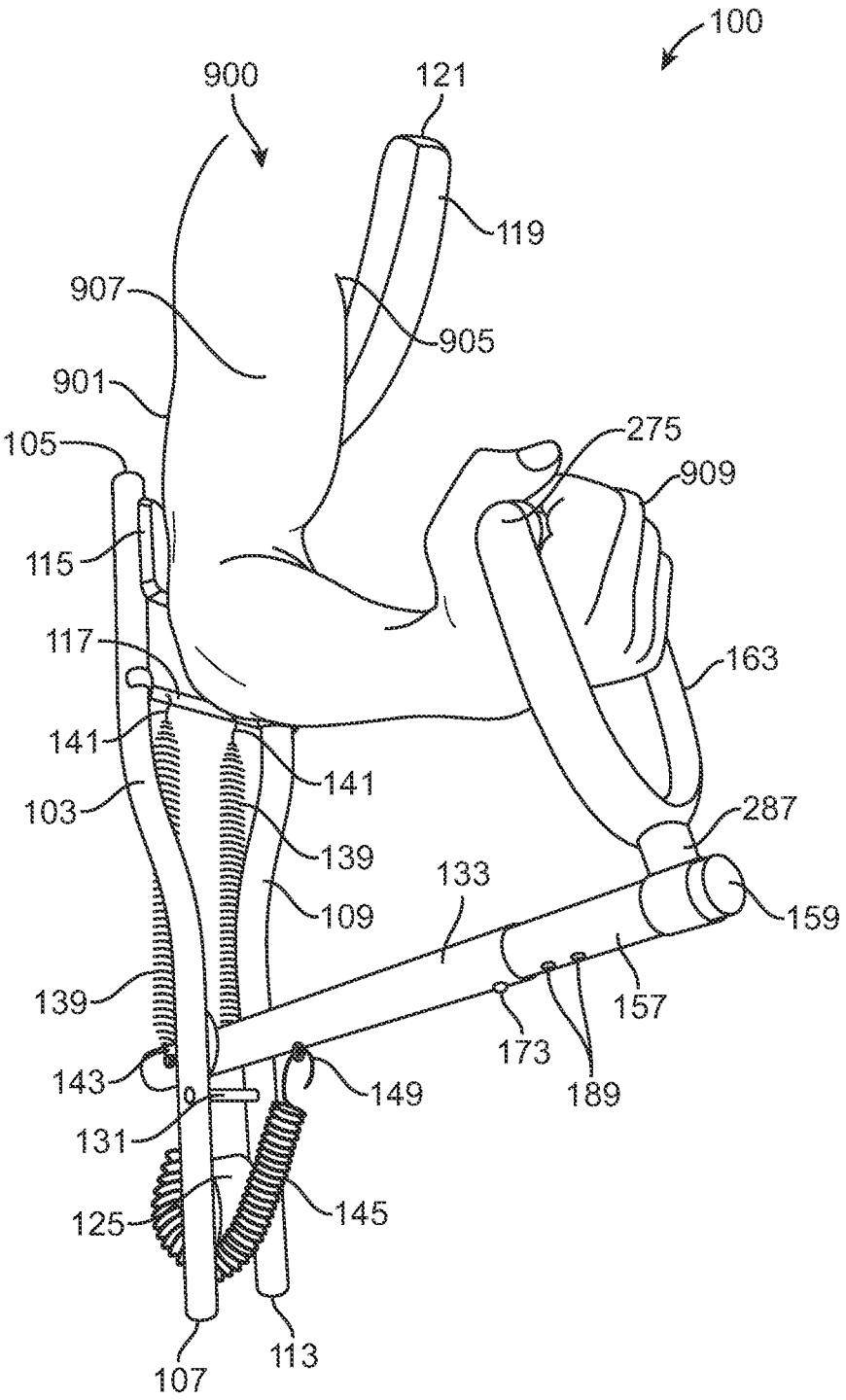
FIG. 1D may depict the embodiment of the portable bicep exercising machine in use with the user from FIG. 1A, with the portable bicep exercising machine in the configuration where the user's bicep muscle is flexed, shown from a right perspective view.
Figure 1E:
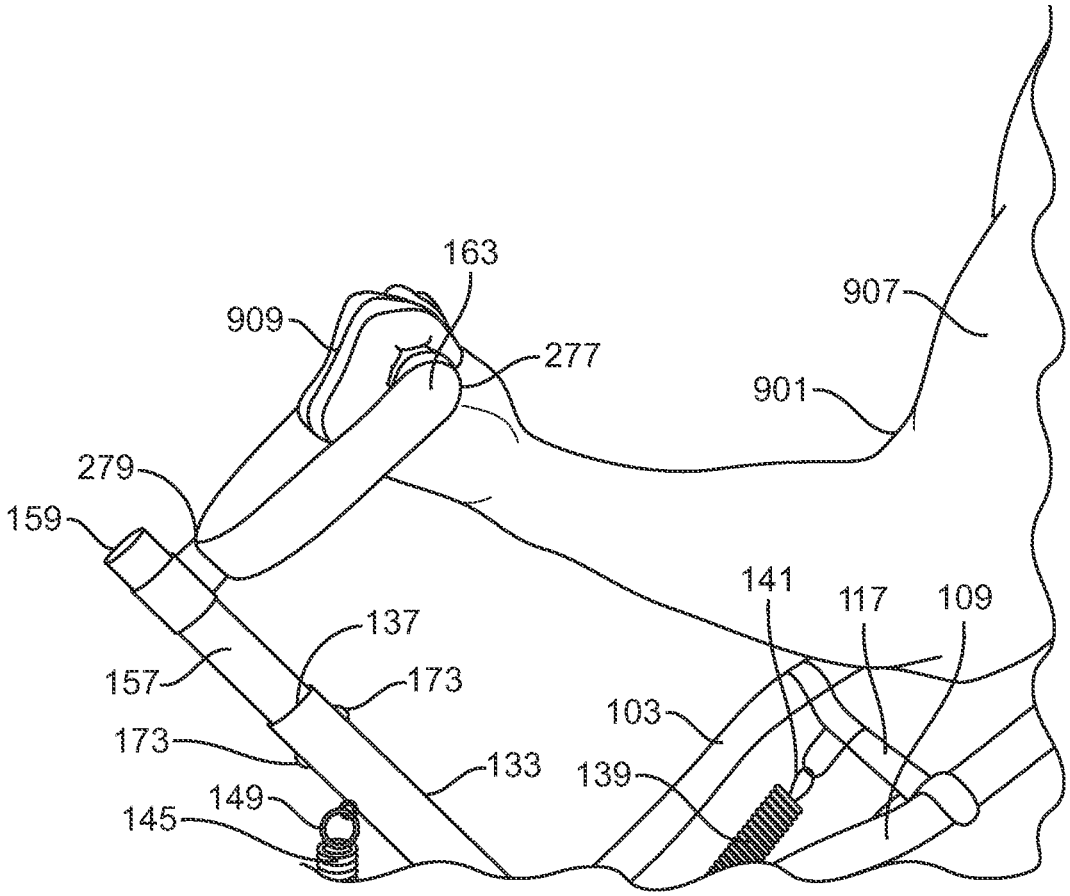
FIG. 1E may depict the embodiment of the portable bicep exercising machine in use with the user from FIG. 1A, with the portable bicep exercising machine in the configuration where the user's bicep muscle is flexed and with the user's wrist in a supinated position, shown from a left perspective view of a right arm of the user.
Figure 1F:
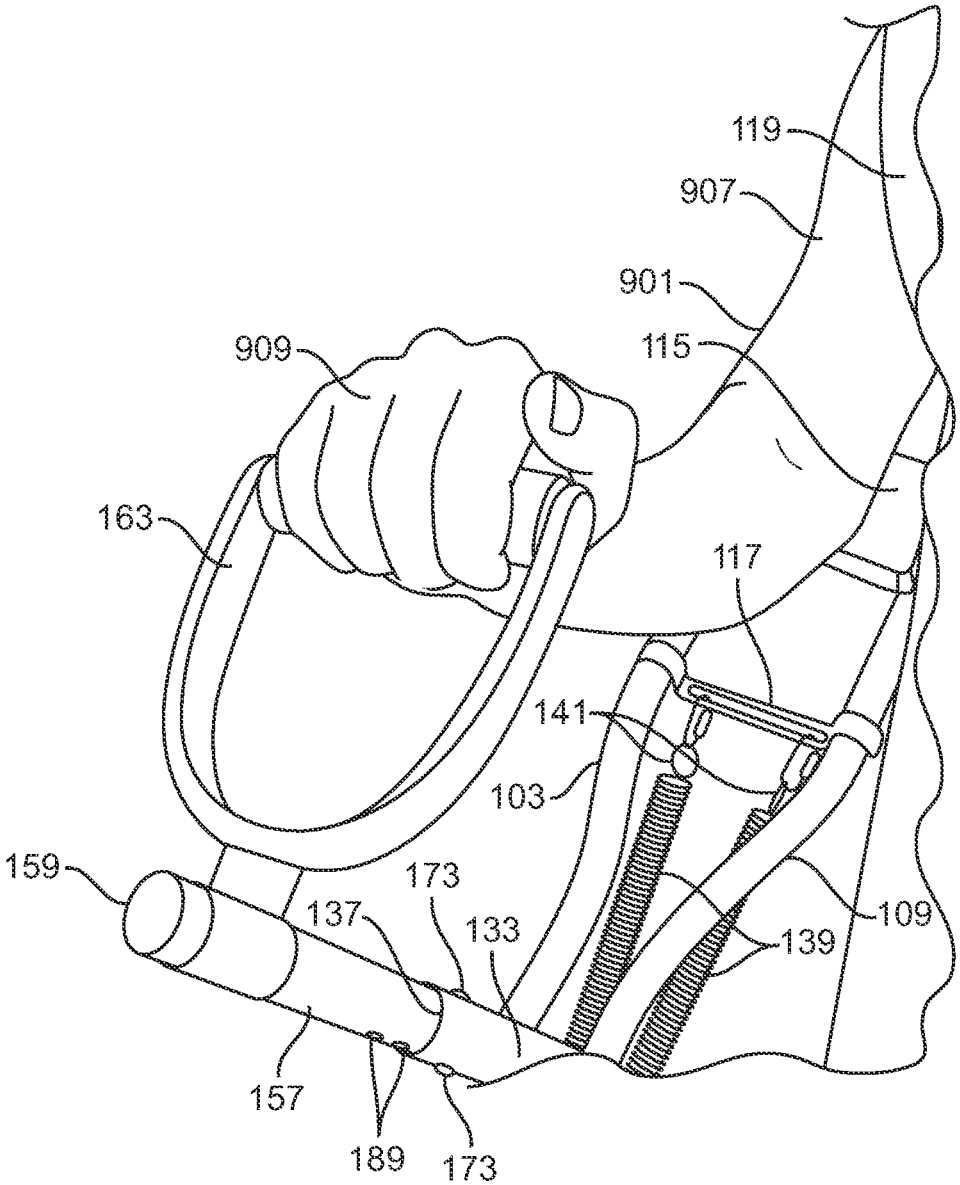
FIG. 1F may depict the embodiment of the portable bicep exercising machine in use with the user from FIG. 1A, with the portable bicep exercising machine in the configuration where the user's bicep muscle is flexed and where the user's wrist is in a pronated position, shown from a right perspective view.
Figure 1G:
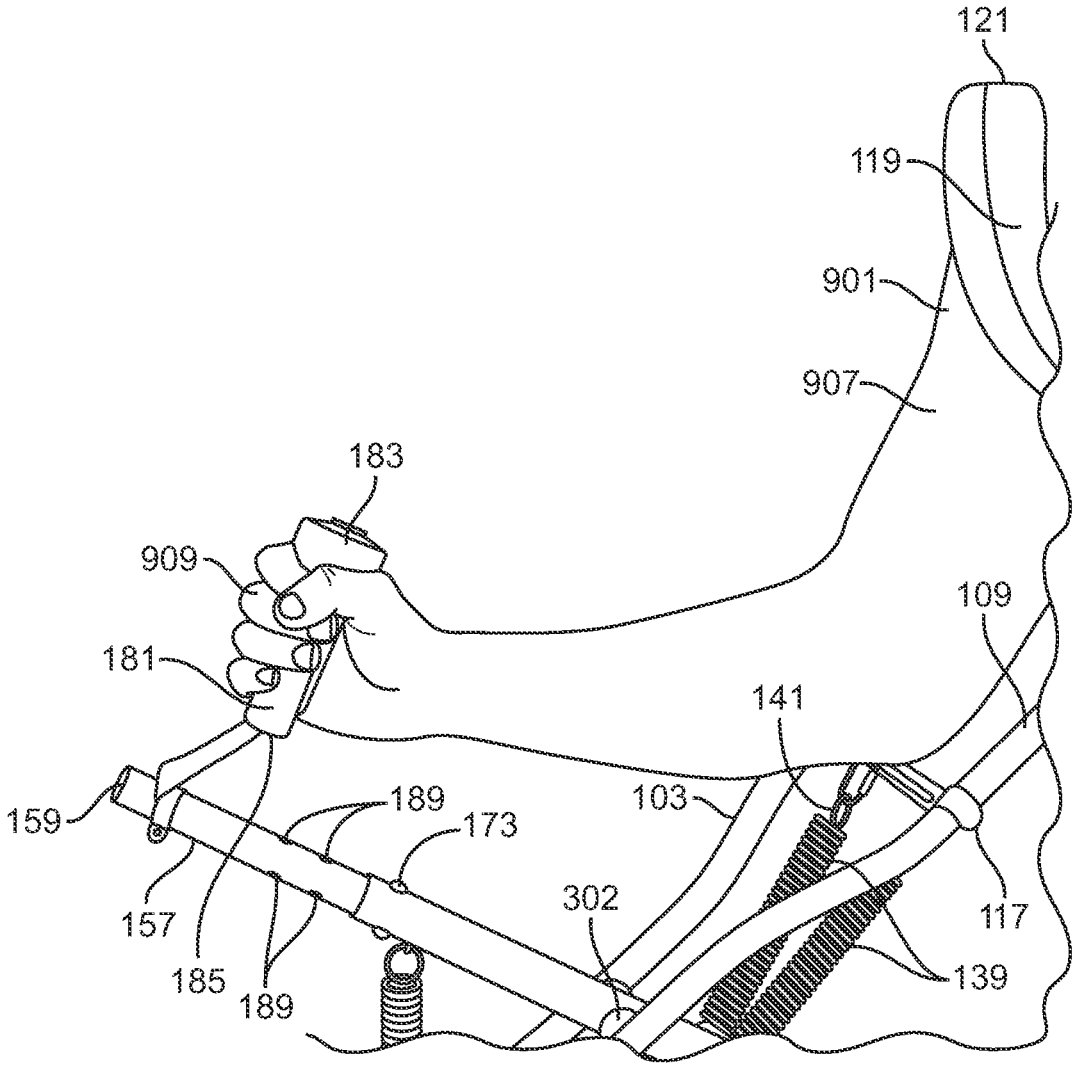
FIG. 1G may depict the embodiment of the portable bicep exercising machine in use with the user from FIG. 1A, with the portable bicep exercising machine in the configuration where the user's bicep muscle is flexed and with the user's wrist in a position for a hammer type curl, shown from a left perspective view of a right arm of the user.

FIG. 1A through and including FIG. 1G may depict various embodiments of portable bicep exercising machines 100 with a user 900.

FIG. 1A may depict portable bicep exercising machine 100 in use with user 900, depicted from a right side. Here in FIG. 1A, portable bicep exercising machine 100 may be in a configuration where user's 900 arm 901 may be extended, i.e., where bicep 907 may not be flexed.

In some embodiments, portable bicep exercising machine 100 may comprise the upper framework, the lower framework, and the one or more resistance means. In some embodiments, the upper framework may comprise first elongate member 103 and second elongate member 109. In some embodiments, the upper framework may comprise first elongate member 103, second elongate member 109, and under-arm pad 119. In some embodiments, the upper framework may comprise further comprise one or more of: tricep pad 115, upper crossbar 117, and lower crossbar 131. In some embodiments, the lower framework may comprise pivoting elongate member 133, inner extending elongate member 157, and handle 163 (and/or short elongate member 181).

In some embodiments, portable bicep exercising machine 100 may comprise: first elongate member 103, second elongate member 109, tricep pad 115, under-arm pad 119, pivoting elongate member 133, handle 163, and at least one tension means (e.g., first tension means 139, second tension means 145, and/or third tension means 251). See e.g., FIG. 1A. In portable bicep exercising machine 100 embodiments utilizing first tension means 139, portable bicep exercising machine 100 may also comprise upper crossbar 117. In portable bicep exercising machine 100 embodiments utilizing second tension means 145, portable bicep exercising machine 100 may also comprise lower crossbar 131 and pulley 125.

Note, each elongate member referred to herein may be longer than wide. In some embodiments, first elongate member 103 may comprise upper terminal end 105 and lower terminal end 107. In some embodiments, upper terminal end 105 and lower terminal end 107 may be opposing terminal ends of first elongate member 103. See e.g., FIG. 1A. In some embodiments, second elongate member 109 may comprise second upper terminal end 111 and second lower terminal end 113. In some embodiments, second upper terminal end 111 and second lower terminal end 113 may be opposing terminal ends of first elongate member 109. See e.g., FIG. 1A. In some embodiments, first elongate member 103 and second elongate member 109 may have substantially same longitudinal lengths. In some embodiments, first elongate member 103 and second elongate member 109 may have substantially same transverse widths. In some embodiments, first elongate member 103 and second elongate member 109 may be substantially parallel to each other. See e.g., FIG. 1A.

In some embodiments, tricep pad 115 may span from first elongate member 103 to second elongate member 109. In some embodiments, a portion of tricep pad 115 may be attached first elongate member 103 and a different portion of tricep pad 115 may be attached to second elongate member 109. In some embodiments, tricep pad 115 may be located closer to upper terminal ends (105 and 111) than to lower terminal ends (107 and 113). In some embodiments, at least some portions of tricep pad 115 may be padded. See e.g., FIG. 1A and FIG. 2A.

In some embodiments, tricep pad 115 may attach to first elongate member 103 and to second elongate member 109 via one or more of: heat welding, chemical adhesive, solvent bonding, ultrasonic bonding, screws, bolts, rivets, pins, nails, staples, clips, friction fit, press fit, and/or any other attachment means suitable for intended permanent attachment.

In some embodiments, upper crossbar 117 may span from first elongate member 103 to second elongate member 109. In some embodiments, a portion of upper crossbar 117 may be attached first elongate member 103 and a different portion of upper crossbar 117 may be attached to second elongate member 109. In some embodiments, upper crossbar 117 may be located closer to upper terminal ends (105 and 111) than to lower terminal ends (107 and 113). In some embodiments, upper crossbar 117 may be located beneath tricep pad 115. In some embodiments, upper crossbar 117 may be disposed between 115 and the lower terminal ends (107 and 113). In some embodiments, upper crossbar 117 may be rigid to semi-rigid. In some embodiments, upper crossbar 117 may serve to provide regions of anchor for upper end(s) 141 of first tension means 139. See e.g., FIG. 1B, FIG. 1D, and FIG. 2A.

In some embodiments, upper crossbar 117 may attach to first elongate member 103 and to second elongate member 109 via one or more of: heat welding, chemical adhesive, solvent bonding, ultrasonic bonding, screws, bolts, rivets, pins, nails, staples, clips, friction fit, press fit, and/or any other attachment means suitable for intended permanent attachment. Note, in some embodiments, upper crossbar 117 may not be permanently attached to first elongate member 103 and to second elongate member 109; but instead may be removable and/or adjustable. See e.g., FIG. 5D and FIG. 5E for adjustable upper crossbar 117.

In some embodiments, portable bicep exercising machine 100 may comprise under-arm pad 119. See e.g., FIG. 1A. In some embodiments, under-arm pad 119 may comprise an upper-pad-terminal-end 121 and a lower-pad-terminal-end 123. See e.g., FIG. 2A. In some embodiments, under-arm pad 119 may be shaped like a quarter-circle. In some embodiments, under-arm pad 119 may be shaped like a quarter-arc. In some embodiments, under-arm pad 119 may be shaped like a portion of an arc. In some embodiments, portions of under-arm pad 119 may be padded. In some embodiments, under-arm pad 119 may be removably attachable to a given elongate member (e.g., 103 or 109). In some embodiments, under-arm pad 119 may be removably attachable to first elongate member 103. In some embodiments, under-arm pad 119 may be removably attachable to second elongate member 109. In some embodiments, lower-pad-terminal-end 123 may be removably attachable to upper terminal end 105 or to second upper terminal end 111. Each respective upper terminal end (e.g., 105 and 111) may comprise a hollow receiving-cavity 295. See e.g., FIG. 2D. In some embodiments, receiving-cavity 295 may be sized to removably receive a portion of lower-pad-terminal-end 123, such that this portion and receiving-cavity 295 frictionally engage and couple with each other. This may permit removable attachment of lower-pad-terminal-end 123 to either respective upper terminal end (e.g., 105 and 111). See e.g., FIG. 2A and FIG. 2D. And that interchange may permit portable bicep exercising machine 100 (or 200) to be used for either a left arm or a right arm of user 900. When portable bicep exercising machine 100 (or 200) may be in use, upper-pad-terminal-end 121 may protrude from a given armpit of user 900. See e.g., FIG. 1A.

FIG. 1B may depict portable bicep exercising machine 100 in use with user 900, depicted from a head on view (i.e., a frontal view of user 900). Here in FIG. 1B, portable bicep exercising machine 100 may be in a configuration where user's 900 arm 901 may be extended, i.e., where bicep 907 may not be flexed.

In portable bicep exercising machine 100 embodiments utilizing pivoting elongate member 133, portable bicep exercising machine 100 may also comprise spring-loaded-push-button 173 and portable bicep exercising machine 100 may also comprise inner extending elongate member 157, a portion of which may fit into a hollow cavity of pivoting elongate member 133. See e.g., FIG. 1B.

FIG. 1C may depict portable bicep exercising machine 100 in use with user 900, depicted from a right side. Here in FIG. 1C, portable bicep exercising machine 100 may be in a configuration where user's 900 arm 901 may bent at an acute angle, i.e., where bicep 907 may be flexed.

In portable bicep exercising machine 100 embodiments utilizing pivoting elongate member 133, portable bicep exercising machine 100 may also comprise pivot-axle 201. See e.g., FIG. 1C. In some embodiments, pivot-axle 201 may link pivoting elongate member 133 to both first elongate member 103 and to second elongate member 109. In some embodiments, pivot-axle 201 may be a rigid elongate member. In some embodiments, pivot-axle 201 may act as a rod or as an axle. In some embodiments, pivot-axle 201 linkage to pivoting elongate member 133 and to both first elongate member 103 and to second elongate member 109 may permit pivoting elongate member 133 to pivot with respect to first elongate member 103 and with respect to second elongate member 109, about pivot-axle 201. Note, second elongate member 109 may not be visible in FIG. 1C; see FIG. 1A or FIG. 1D for second elongate member 109.

In some embodiments, pivoting elongate member 133 may be rigid to semi-rigid. In some embodiments, pivoting elongate member 133 may be substantially or partially hollow along a longitudinal length of pivoting elongate member 133. In some embodiments, pivoting elongate member 133 may comprise a pair of opposing terminal ends, closed terminal end 135 and open terminal end 137. In some embodiments, closed terminal end 135 may be closed and not provide access to hollow portions of pivoting elongate member 133. In some embodiments, open terminal end 137 may provide access to hollow portions of pivoting elongate member 133. See e.g., FIG. 1A, FIG. 1B, and FIG. 1D.

In portable bicep exercising machine 100 embodiments utilizing pivoting elongate member 133, portable bicep exercising machine 100 may also comprise inner extending elongate member 157. In some embodiments, inner extending elongate member 157 may be rigid to semi-rigid. In some embodiments, inner extending elongate member 157 may comprise two opposing terminal ends, an outer terminal end 159 and an enclosed terminal end 161. When a given bicep exercising machine (e.g., 100 or 200) may be in use, enclosed terminal end 161 may be captured within the hollow portion of pivoting elongate member 133. When a given bicep exercising machine (e.g., 100 or 200) may be in use, outer terminal end 159 may protrude from the hollow portion of pivoting elongate member 133. Note, enclosed terminal end 161 may not be shown in the figures. In some embodiments, enclosed terminal end 161 may slide into open terminal end 137 of pivoting elongate member 133. See e.g., FIG. 1A, FIG. 1B, and FIG. 1D. Communication between spring-loaded-push-button 173 and receiving-holes 189 may permit telescoping lockage at predetermined intervals of inner extending elongate member 157 with respect to pivoting elongate member 133. See e.g., FIG. 1C, FIG. 1D, and FIG. 1F. Receiving-holes 189 may be located in the predetermined internals along a longitude of inner extending elongate member 157. Receiving-holes 189 may also be located in at predetermined distance from open terminal end 137 of pivoting elongate member 133. When receiving-holes 189 of pivoting elongate member 133 are concentric with receiving-holes of inner extending elongate member 157, lockage via spring-loaded-push-button 173 may occur. In some embodiments, inner extending elongate member 157 may comprise a plurality of receiving-holes 189 arranged along a longitudinal length of inner extending elongate member 157. In some embodiments, each receiving-hole 189 selected from the plurality of receiving-holes 189 may be sized to removably receive spring-loaded-push-button 173, such that the inner extending elongate member 157 is slidable along its longitudinal length with respect to the pivoting elongate member 133. And in some embodiments, this slidable communicative relationship may also permit locking at predetermined intervals along the longitudinal length of inner extending elongate member 157. See e.g., FIG. 1F.

FIG. 1D may depict portable bicep exercising machine 100 in use with user 900, depicted from a partial right frontal view. Here in FIG. 1D, portable bicep exercising machine 100 may be in a configuration where user's 900 arm 901 may bent at an acute angle, i.e., where bicep 907 may be flexed.

In some embodiments, a majority of first tension means 139 may be one or more springs and/or one or more elastic members, such as a resistance band. In portable bicep exercising machine 100 embodiments utilizing first tension means 139, there may be an upper end 141 of first tension means 139 attached to upper crossbar 117 and a lower end 143 of first tension means 139 attached to pivoting elongate member 133. See e.g., FIG. 1D.

In portable bicep exercising machine 100 embodiments utilizing second tension means 145, portable bicep exercising machine 100 may also comprise pulley 125. In some embodiments, pulley 125 may comprise first side 127 and second side 229; wherein second side 229 may oppose first side 127. See FIG. 1A for first side 127 and see FIG. 2A for second side 229. In some embodiments, first side 127 of pulley 125 may be attached to first elongate member 103. A nature of attachment between pulley 125 and first elongate member 103 may permit rotational movement of pulley 125 about its axis. In some embodiments, second side 229 of pulley 125 may be attached to second elongate member 109. A nature of attachment between pulley 125 and second elongate member 109 may permit rotational movement of pulley 125 about its axis. In some embodiments, pulley 125 may be located in between first elongate member 103 and second elongate member 109. In some embodiments, pulley 125 may be closer to each respective lower end (e.g., 107 and 113) than each respective upper end (e.g., 105 and 111). In some embodiments, a portion of second tension means 145 may run along a channel of the pulley 125. In some embodiments, this portion of second tension means 145 may be one or more springs and/or one or more elastic members, such as a resistance band. This channel of pulley 125 may be disposed between first side 127 and second side 229. In some embodiments, second tension means 145 may comprise a first end 147 attached to lower crossbar 131 and a second end 149 attached to pivoting elongate member 133. See e.g., FIG. 1D for lower crossbar 131; although in FIG. 1D, first end 147 attaching to lower crossbar 131 is not visible due to angle of the view of FIG. 1D. See also, FIG. 2B and FIG. 2G, where first end 147 attached to lower crossbar lower crossbar 131 is shown. In some embodiments, lower crossbar 131 may be rigid to semi-rigid. In some embodiments, lower crossbar 131 may span first elongate member 103 to second elongate member 109. In some embodiments, lower crossbar 131 may be attached to first elongate member 103 and attached to second elongate member 109. In some embodiments, lower crossbar 131 may be disposed between first elongate member 103 and second elongate member 109. In some embodiments, lower crossbar 131 may be located closer to respective lower terminal ends (103 and 111) than to respective upper terminal ends (105 and 113). See e.g., FIG. 1D.

In some embodiments, lower crossbar 131 may attach to first elongate member 103 and to second elongate member 109 via one or more of: heat welding, chemical adhesive, solvent bonding, ultrasonic bonding, screws, bolts, rivets, pins, nails, staples, clips, friction fit, press fit, and/or any other attachment means suitable for intended permanent attachment.

In some embodiments, portable bicep exercising machine 100 may comprise a handle 163. Handle 163 may be configured to be comfortably gripped by user 900. In some embodiments, handle 163 may be linked to a region proximate (e.g., within three inches) to open terminal end 137 of pivoting elongate member 133, this embodiment may not be depicted. In some embodiments, handle 163 may be linked to a region proximate (e.g., within three inches) to outer terminal end 159 of inner extending elongate member 157. See e.g., FIG. 1A. When user 900 grips handle 163 in one hand 909 of an arm 901 and places a tricep 903 of that same arm 901 against tricep pad 115 and places under-arm pad 119 within and/or against an armpit 905 of that same arm 901, user 900 may then perform various curling exercises, where resistance may be provided by the at least one tension means (e.g., first tension means 139, second tension means 145, and/or third tension means 251).

FIG. 1E may depict portable bicep exercising machine 100 in use with user 900, depicted from a left side, but where same arm 901 (e.g., a right arm) of user 900 may be engaged. Here in FIG. 1E, portable bicep exercising machine 100 may be in a configuration where user's 900 arm 901 may bent at an acute angle, i.e., where bicep 907 may be flexed. FIG. 1E may be to show use of portable bicep exercising machine 100 where user's 900 wrist is in a supinated position, i.e., a standard bicep curl position.

FIG. 1F may depict the embodiment of the portable bicep exercising machine 100 in use with user 900, with portable bicep exercising machine 100 in the configuration where the user's 900 bicep muscle 907 may be flexed and where user's 900 wrist may be in a pronated position, where hand 909 may be placed on the top of handle 163, shown from a right perspective view (a partial view of portable bicep exercising machine 100 and of user 900 may be shown). Whereas, in FIG. 1A through FIG. 1E, user's 900 wrist may be in the supinated position for a standard bicep curl position.

FIG. 1G may depict the embodiment of portable bicep exercising machine 100 in use with user 900, with portable bicep exercising machine 100 in configuration where the user's 900 bicep muscle 907 may be flexed and with the user's 900 wrist in a position for a hammer type curl, shown from a left perspective view of a right arm of the user.

When 100 may be used for hammer curls, handle 163 may be replaced with short elongate member 181. See e.g., FIG. 1G. In some embodiments, portable bicep exercising machine 100 may comprise short elongate member 181. In some embodiments, short elongate member 181 may comprise an upper terminal cap 183 and a lower terminal cap 185. In some embodiments, lower terminal cap 185 may be connected to inner extending elongate member 157. In some embodiments, lower terminal cap 185 may be connected to outer terminal end 159 of inner extending elongate member 157. In some embodiments, lower terminal cap 185 may be connected proximate (e.g., within three inches) to outer terminal end 159 of inner extending elongate member 157. In some embodiments, attachment of lower terminal cap 185 to inner extending elongate member 157 may be via an intermediary linkage, such as, but not limited to a predetermined length of cordage or strapping, as in a leash. See e.g., FIG. 1G. In some embodiments, at least a portion of short elongate member 181 may be covered with soft foam, soft rubber, and/or fabric that may facilitate user 900 comfort and minimize slippage.

Figure 2A:
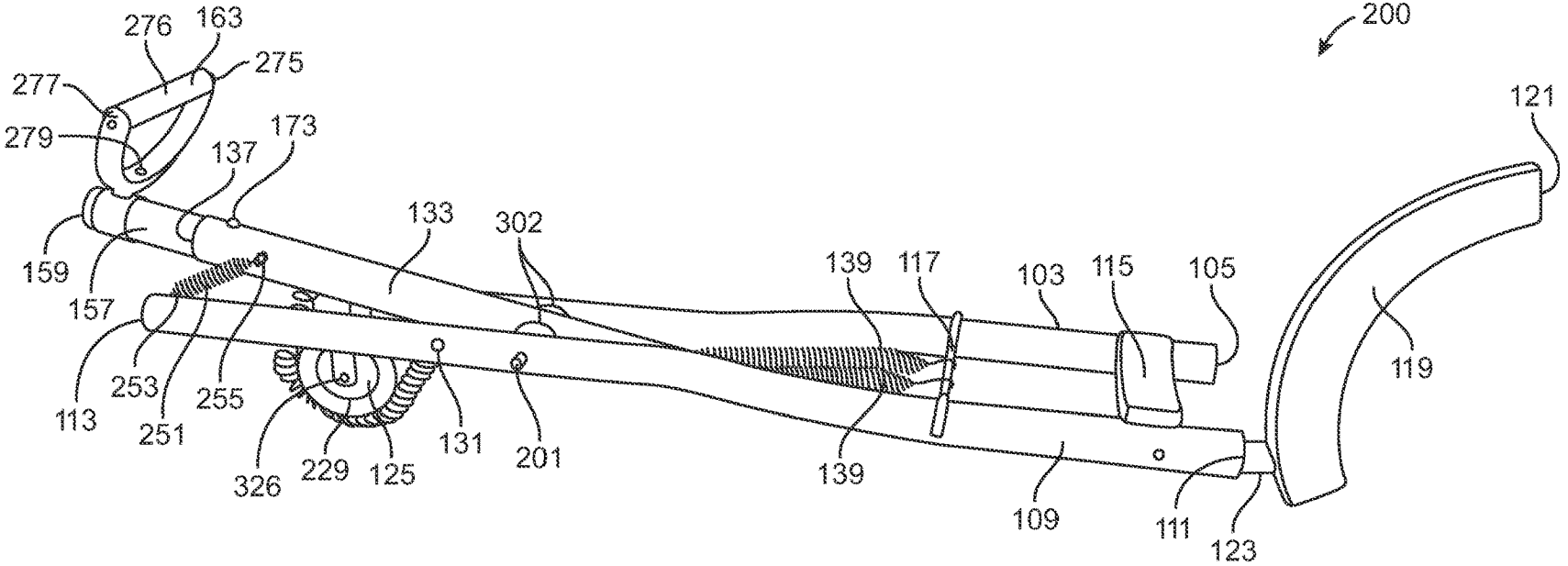
FIG. 2A may depict an embodiment of a portable bicep exercising machine, depicted from a left perspective view.
Figure 2B:
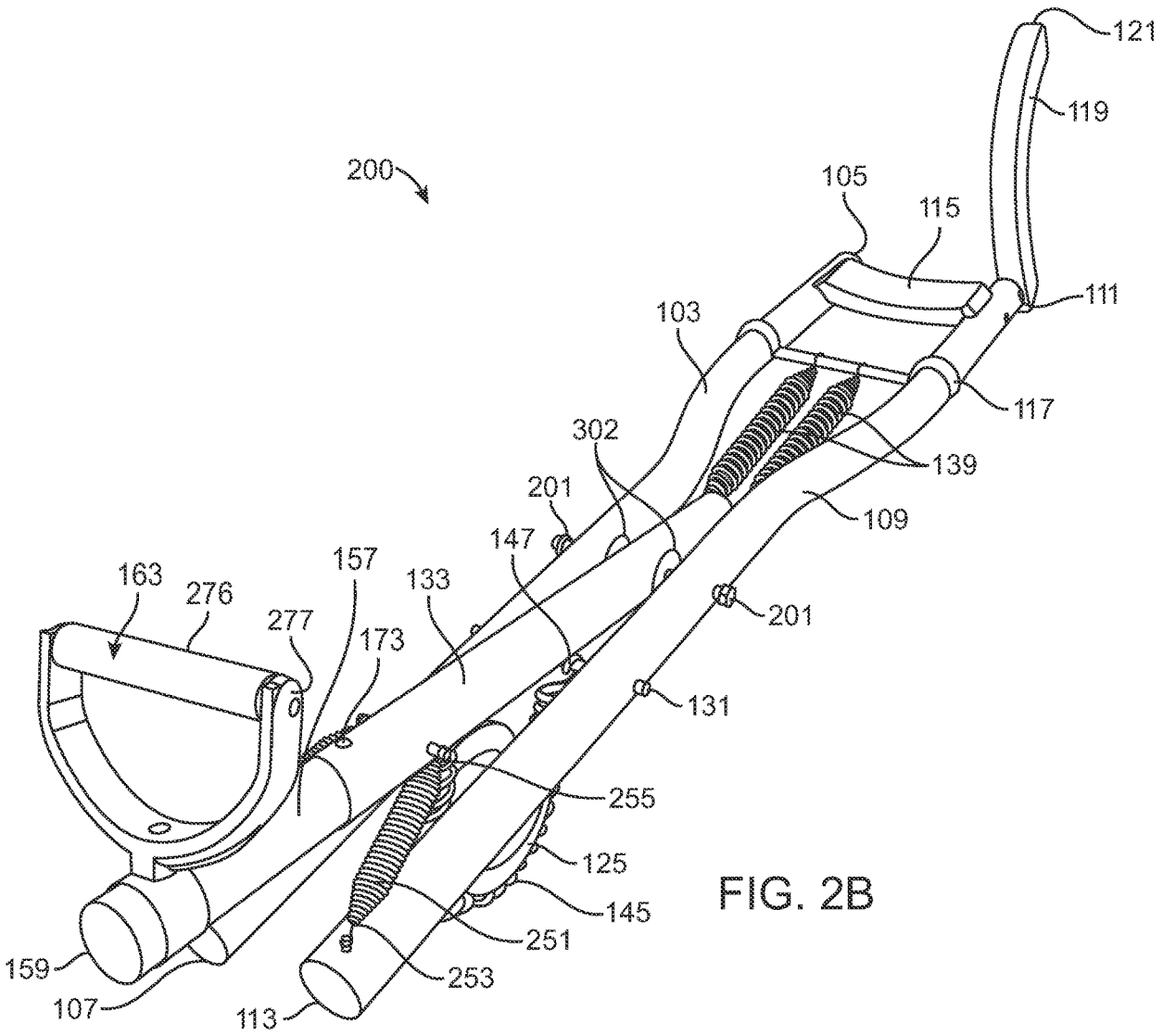
FIG. 2B may depict the embodiment of the portable bicep exercising machine from FIG. 2A, depicted from a left front perspective view.
Figure 2C:
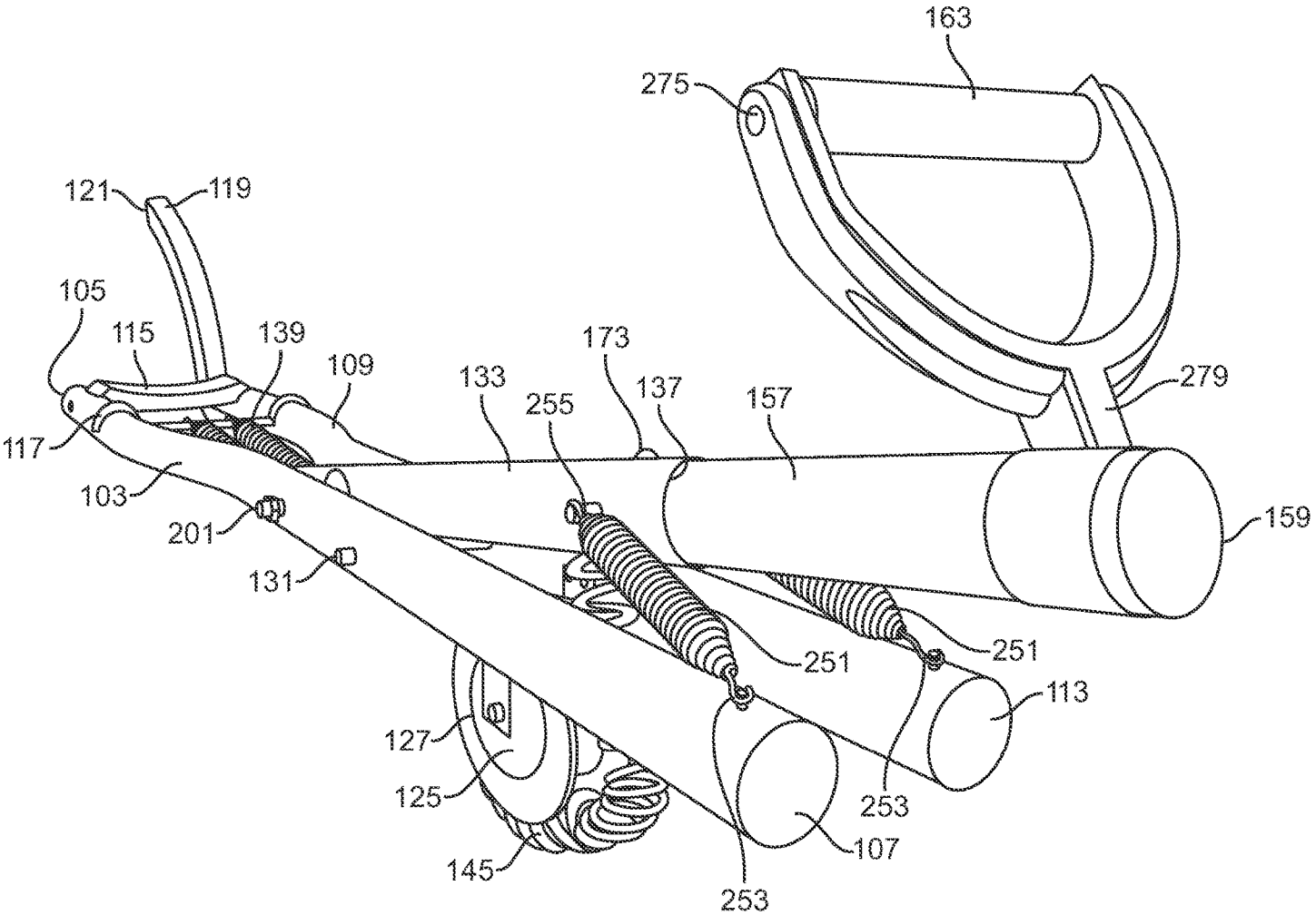
FIG. 2C may depict the embodiment of the portable bicep exercising machine from FIG. 2A, depicted from a right front perspective view.
Figure 2D:
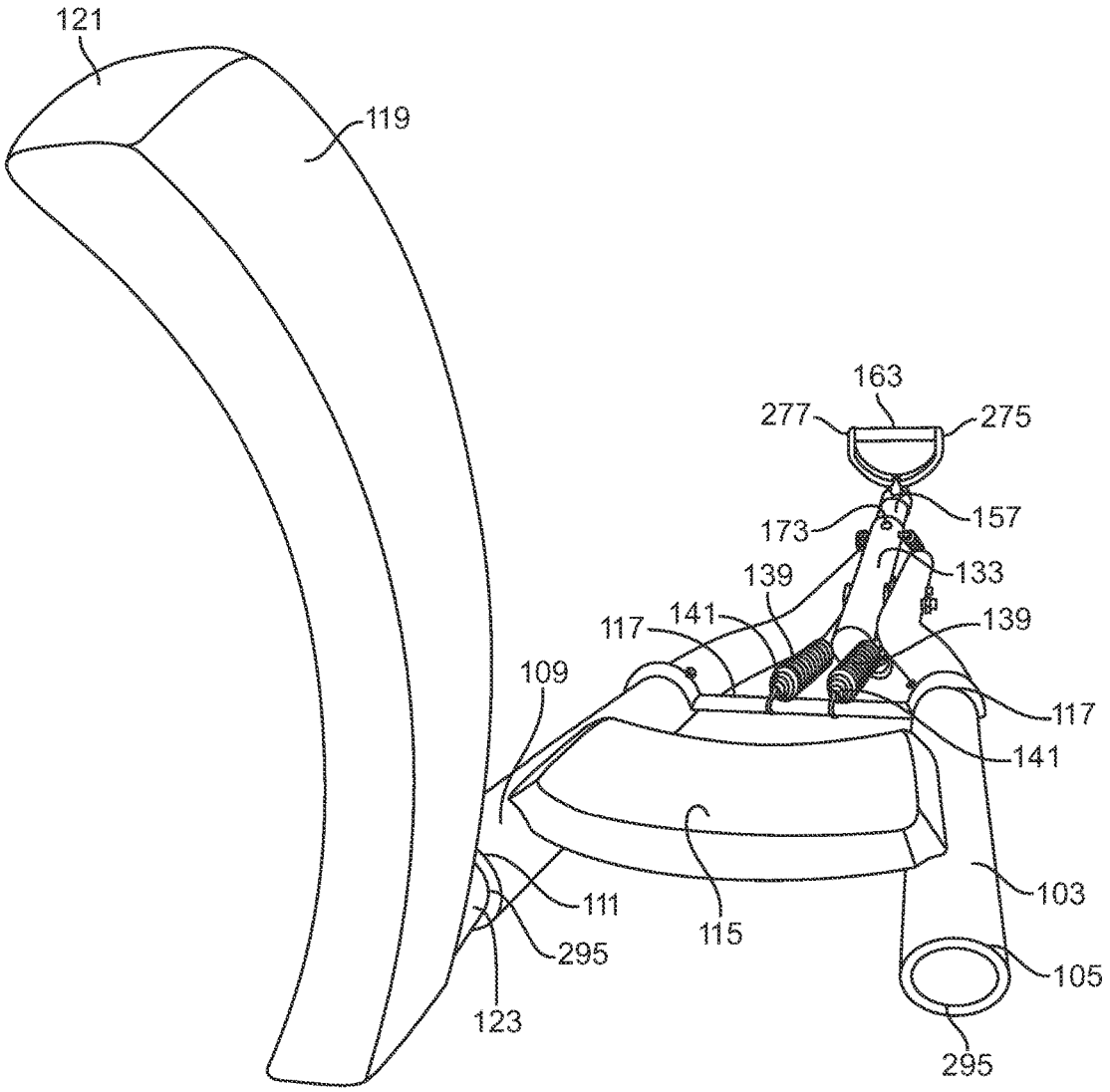
FIG. 2D may depict the embodiment of the portable bicep exercising machine from FIG. 2A, depicted from a back perspective view.
Figure 2E:
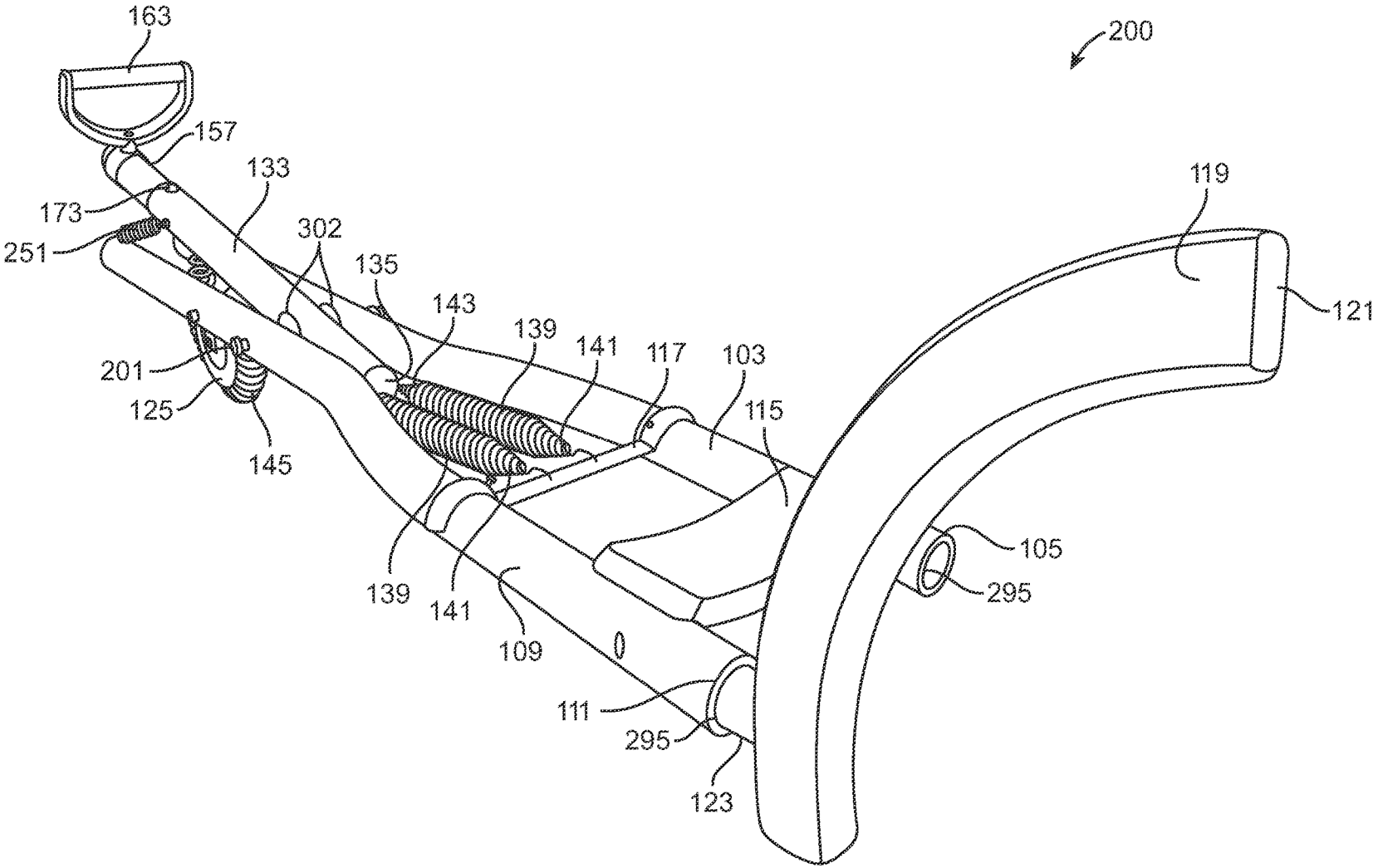
FIG. 2E may depict the embodiment of the portable bicep exercising machine from FIG. 2A, depicted from a left back perspective view.
Figure 2F:
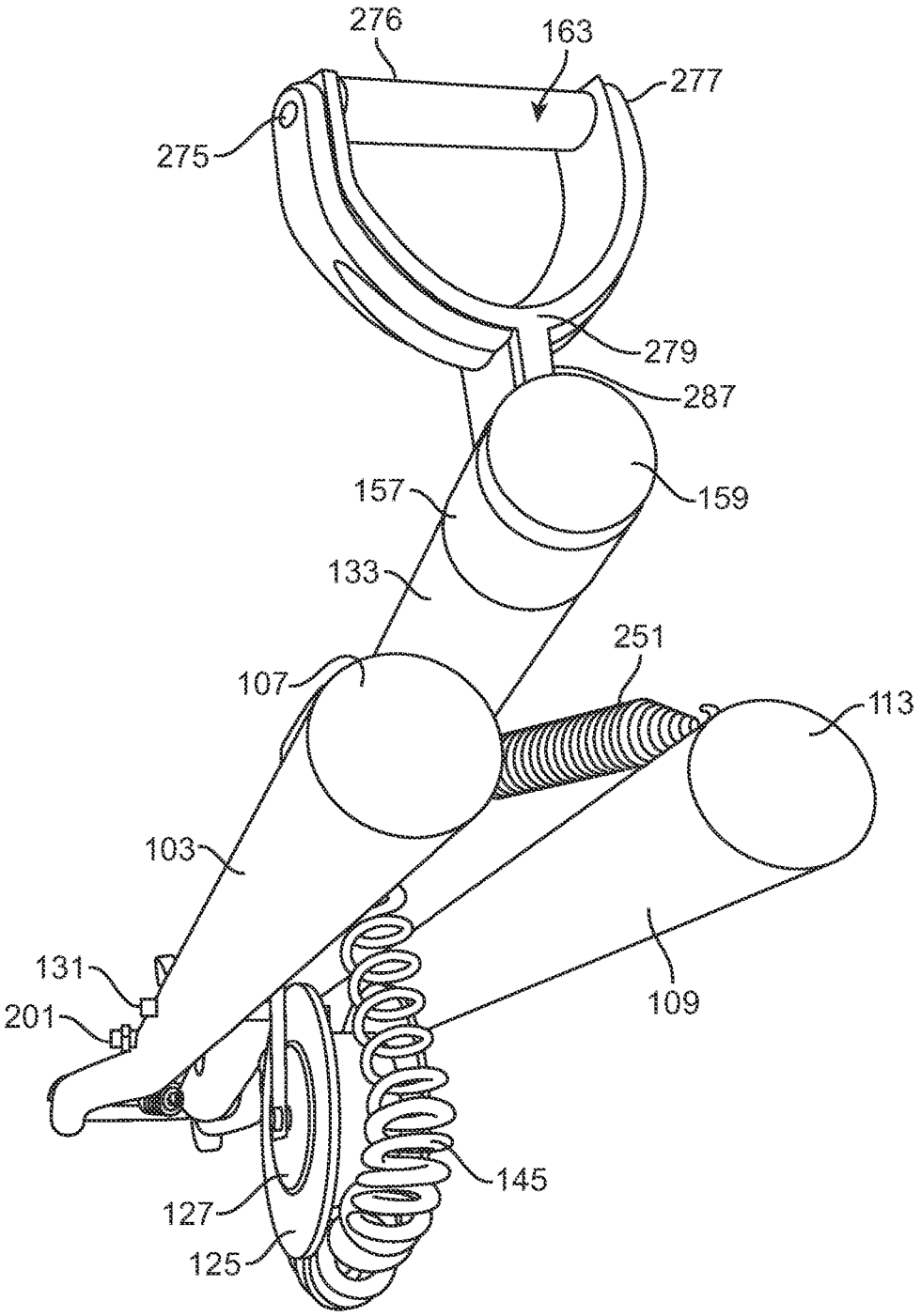
FIG. 2F may depict the embodiment of the portable bicep exercising machine from FIG. 2A, depicted from a front bottom perspective view.
Figure 2G:
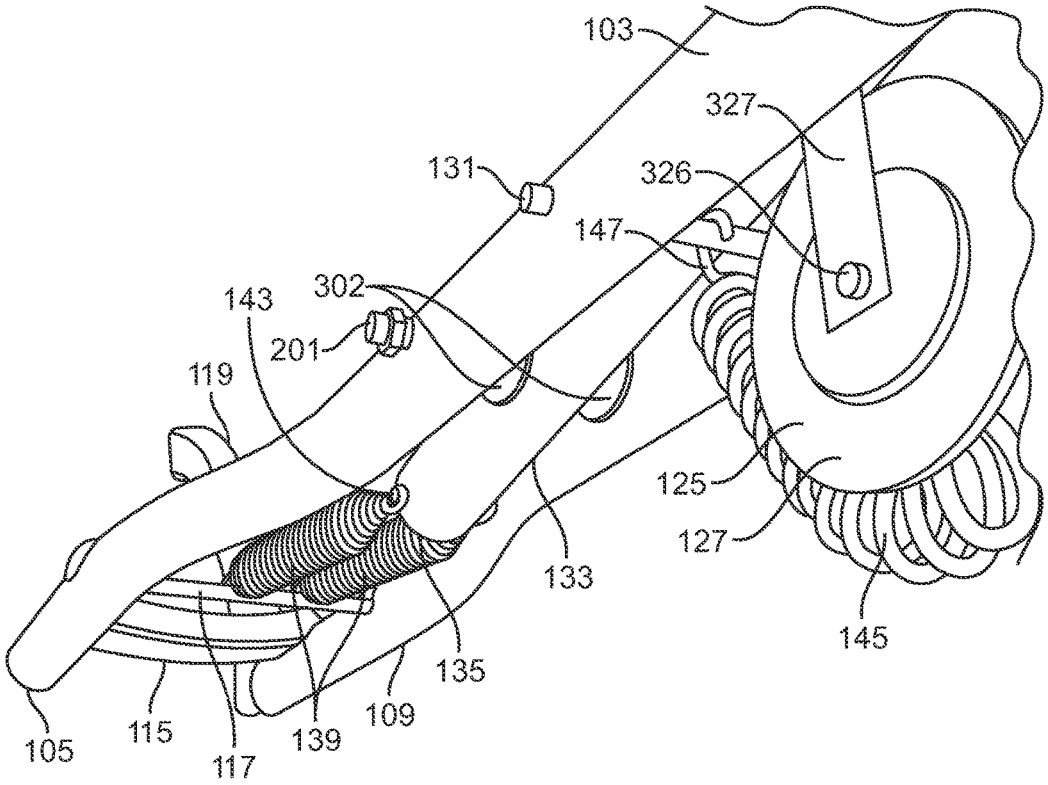
FIG. 2G may depict a portion of the embodiment of the portable bicep exercising machine from FIG. 2A, depicted from a partial bottom perspective view.
Figure 2H:
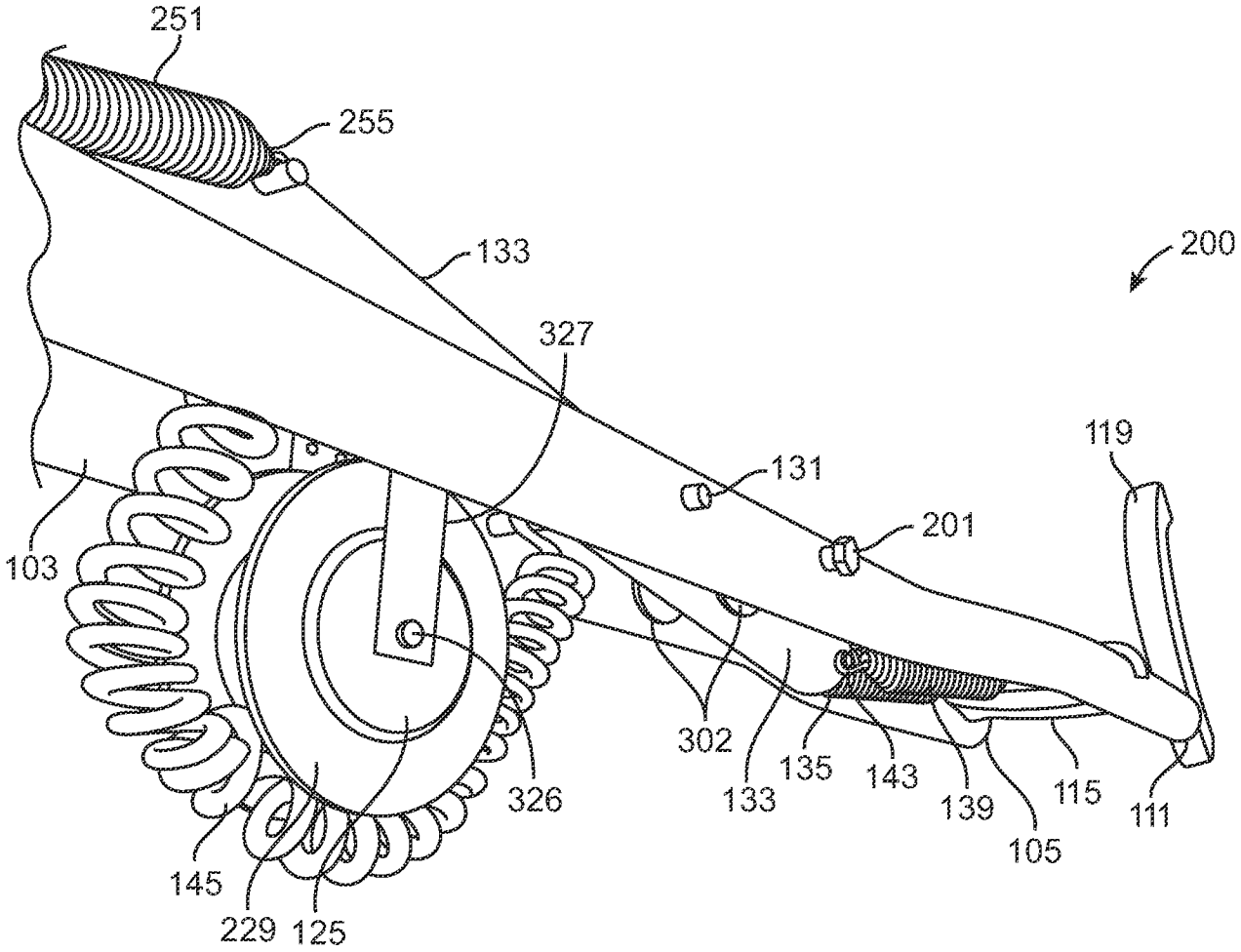
FIG. 2H may depict a portion of the the embodiment of the portable bicep exercising machine from FIG. 2A, depicted from a partial left bottom perspective view.

FIG. 2A through and including FIG. 2H may depict various embodiments of portable bicep exercising machines 200 but without depicting user 900.

FIG. 2A may depict portable bicep exercising machine 200, depicted from a left side. In some embodiments, portable bicep exercising machine 200 may comprise: first elongate member 103, second elongate member 109, tricep pad 115, under-arm pad 119, pivoting elongate member 133, handle 163, and at least one tension means (e.g., first tension means 139, second tension means 145, and/or third tension means 251). For example, in FIG. 2A three tension means of first tension means 139, second tension means 145, and third tension means 251 may be depicted. Components discussed as components of portable bicep exercising machine 100, that may also be components in portable bicep exercising machine 200, may be as discussed under the FIG. 1A through FIG. 1G. In some embodiments, portable bicep exercising machine 200 may differ from portable bicep exercising machine 100, by inclusion of third tension means 251 in portable bicep exercising machine 200.

In some embodiments, handle 163 may comprise: an outer opposite terminal point 275, an inner opposite terminal point 277, a grip bar 276, and a lower terminal point 279. Grip bar 276 may a portion of handle 163 that intended to be gripped by user 900. In some embodiments, grip bar 276 may be disposed between outer opposite terminal point 275 and inner opposite terminal point 277. In some embodiments, grip bar 276 may be attached to outer opposite terminal point 275 and attached to inner opposite terminal point 277. In some embodiments, grip bar 276 may be covered with soft foam, soft rubber, and/or fabric that may facilitate user 900 comfort and minimize slippage. See e.g., FIG. 2A. In some embodiments, lower terminal point 279 of handle 163 may attach to outer terminal end 159 of inner extending elongate member 157. In some embodiments, lower terminal point 279 of handle 163 may attach to outer terminal end 159 of inner extending elongate member 157 through a ball joint 287 to facilitate spherical directional movement of handle 163 with respect to inner extending elongate member 157.

In some embodiments, portable bicep exercising machine 200 may comprise third tension means 251. In some embodiments, a majority of third tension means 251 may be one or more springs and/or one or more elastic members, such as a resistance band. In some embodiments, third tension means 251 may comprise a first-tension-end 253 and an opposing second-tension-end 255. In some embodiments, first-tension-end 253 may be attached proximate to one or more of lower terminal end 107 of the first elongate member 103 or to second lower terminal end 113 of the second elongate member 109. In some embodiments, second-tension-end 255 may be attached to pivoting elongate member 133 closer to open terminal end 137 than to closed terminal end 135. See e.g., FIG. 2A.

In some embodiments, third tension means 251 has a hook or a loop at first-tension-end 253 that attaches to a slot, a hole, or a loop on one or more of the lower terminal end 107 of the first elongate member 103 and/or of the second lower terminal end 113 of the second elongate member 109.

In some embodiments, third tension means 251 has a hook or a loop at the second-tension-end 255 that is received at a nob, a hole, a loop, or a slot on the pivoting elongate member 133.

FIG. 2B may depict portable bicep exercising machine 200, depicted from a front-left side. In some embodiments of portable bicep exercising machine 200, there may be two first tension means 139 (e.g., two springs). See e.g., FIG. 2B.

FIG. 2C may depict portable bicep exercising machine 200, depicted from a front-right side. In some embodiments of portable bicep exercising machine 200, there may be two third tension means 251 (e.g., two springs). See e.g., FIG. 2C.

FIG. 2D may depict portable bicep exercising machine 200, depicted from the rear. FIG. 2D may a first figure to show hollow receiving-cavity 295 of first elongate member 103. In some embodiments, portable bicep exercising machine 200 may comprise under-arm pad 119. In some embodiments, under-arm pad 119 may comprise upper-pad-terminal-end 121 and lower-pad-terminal-end 123. In some embodiments, under-arm pad 119 may be shaped like a quarter-circle. In some embodiments, under-arm pad 119 may be shaped like a quarter-arc. In some embodiments, under-arm pad 119 may be shaped like a portion of an arc. In some embodiments, portions of under-arm pad 119 may be padded. In some embodiments, under-arm pad 119 may be removably attachable to a given elongate member (e.g., 103 or 109). In some embodiments, under-arm pad 119 may be removably attachable to first elongate member 103. In some embodiments, under-arm pad 119 may be removably attachable to second elongate member 109. In some embodiments, lower-pad-terminal-end 123 may be removably attachable to upper terminal end 105 or to second upper terminal end 111. Each respective upper terminal end (e.g., 105 and 111) may comprise hollow receiving-cavity 295. See e.g., FIG. 2D. In some embodiments, receiving-cavity 295 may be sized to removably receive a portion of lower-pad-terminal-end 123, such that this portion and receiving-cavity 295 frictionally engage and couple with each other. This may permit removable attachment of lower-pad-terminal-end 123 to either respective upper terminal end (e.g., 105 and 111). And that interchange may permit portable bicep exercising machine 100 (or 200) to be used for either a left arm or a right arm of user 900. When portable bicep exercising machine 100 (or 200) may be in use, upper-pad-terminal-end 121 may protrude from a given armpit of user 900. See e.g., FIG. 1A.

FIG. 2E may depict portable bicep exercising machine 200, depicted from the left-rear side. Hollow receiving-cavity 295 of first elongate member 103 may be seen in FIG. 2E.

FIG. 2F may depict portable bicep exercising machine 200, depicted from the front-under side. In FIG. 2F, second tension means 145 may be seen with a portion residing within the channel of pulley 125.

FIG. 2G may depict portable bicep exercising machine 200, depicted from the right-under side. In FIG. 2G, one of lower end 143 of first tension means 139 may be seen attached to pivoting elongate member 133 at or proximate (e.g., within three inches) to closed terminal end 135.

FIG. 2H may depict portable bicep exercising machine 200, depicted from the left side. In FIG. 2H, one of lower end 143 of first tension means 139 may be seen attached to pivoting elongate member 133 at or proximate (e.g., within three inches) to closed terminal end 135.

Figure 3:
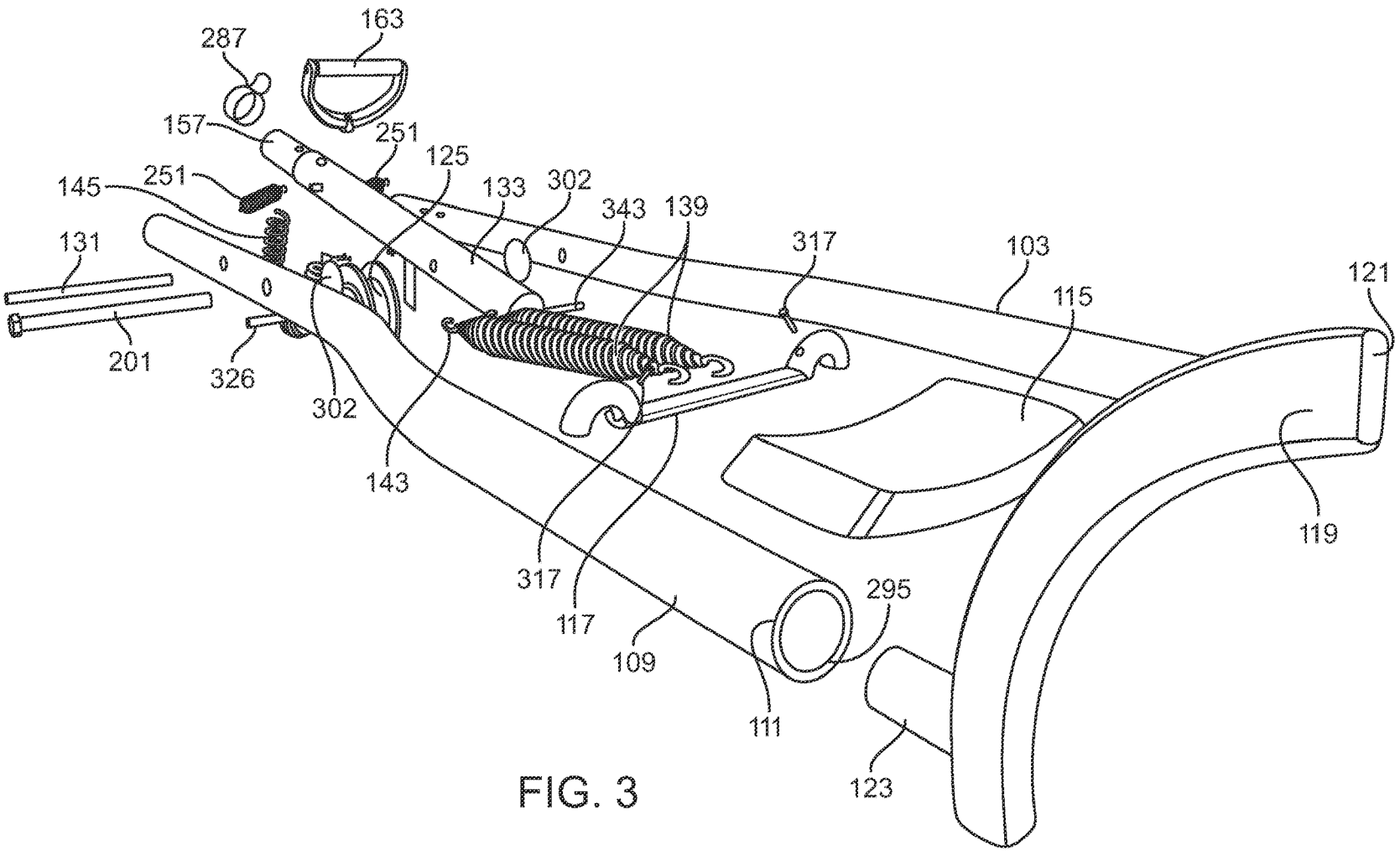
FIG. 3 may depict the embodiment of the portable bicep exercising machine from FIG. 2A, depicted from a left back exploded perspective view.

FIG. 3 may depict portable bicep exercising machine 200 from FIG. 2A, depicted from a left back exploded perspective view. Note, in FIG. 3, pivoting elongate member 133 has not been exploded from inner extending elongate member 157; and thus enclosed terminal end 161 of inner extending elongate member 157 may be not be seen. This exploded view of FIG. 3 may show some additional components of portable bicep exercising machine 200.

In some embodiments, portable bicep exercising machine 200 may further comprise a pair of bushings 302. One bushing 302 may be disposed between pivoting elongate member 133 and first elongate member 103, to minimize friction and rubbing between pivoting elongate member 133 and first elongate member 103. While the other remaining bushing 302 may be disposed pivoting elongate member 133 and second elongate member 109, again to minimize friction and rubbing. In some embodiments, pivot-axle 201 may pass through each bushing 302. See e.g., FIG. 3.

In some embodiments, portable bicep exercising machine 200 may further comprise a pair of opposing set screws 317. See e.g., FIG. 3. These set screws 317 may be for setting a location of upper crossbar 117 along the longitude of first elongate member 103 and of second elongate member 109. In some embodiments, first elongate member 103 and/or second elongate member 109 may comprise a plurality of receiving holes for these set screws 317 at predetermined intervals along the longitude of first elongate member 103 and of second elongate member 109. In some embodiments, these set screws 317 may let the location by frictional engagement with first elongate member 103 and second elongate member 109. Varying the location of upper crossbar 117 may increase or decrease tension associated with first tension means 139. See also FIG. 5D for using set screws 317 to set and/or varying the location of upper crossbar 117.

In some embodiments, pulley 125 of portable bicep exercising machine 200 may further comprise a pulley bracket 327 and a pulley axle 326. Pulley axle 326 may pass through a central through hole of pulley 125 that is concentric with the axis of pulley 125. Pulley axle 326 may permit rotational movement of pulley 125 about the axis of pulley 125. Pulley axle 326 may also pass through receiving holes in pulley bracket 327. Pulley bracket 327 may be disposed between first elongate member 103 and second elongate member 109. Pulley bracket 327 may be attached to first elongate member 103 and to second elongate member 109. See also, FIG. 5C for pulley axle 326 and pulley bracket 327.

Figure 4A:
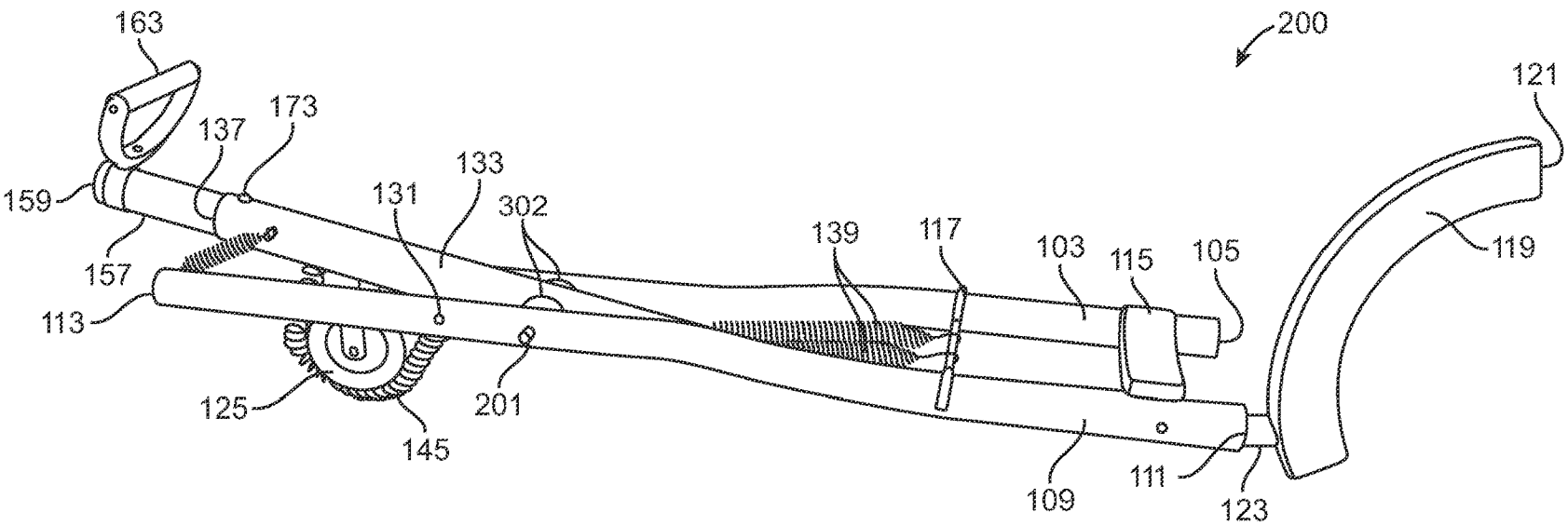
FIG. 4A may depict the embodiment of the portable bicep exercising machine from FIG. 2A, depicted from a left perspective view; wherein an under-arm pad may be removably attached to a second elongate member.
Figure 4B:
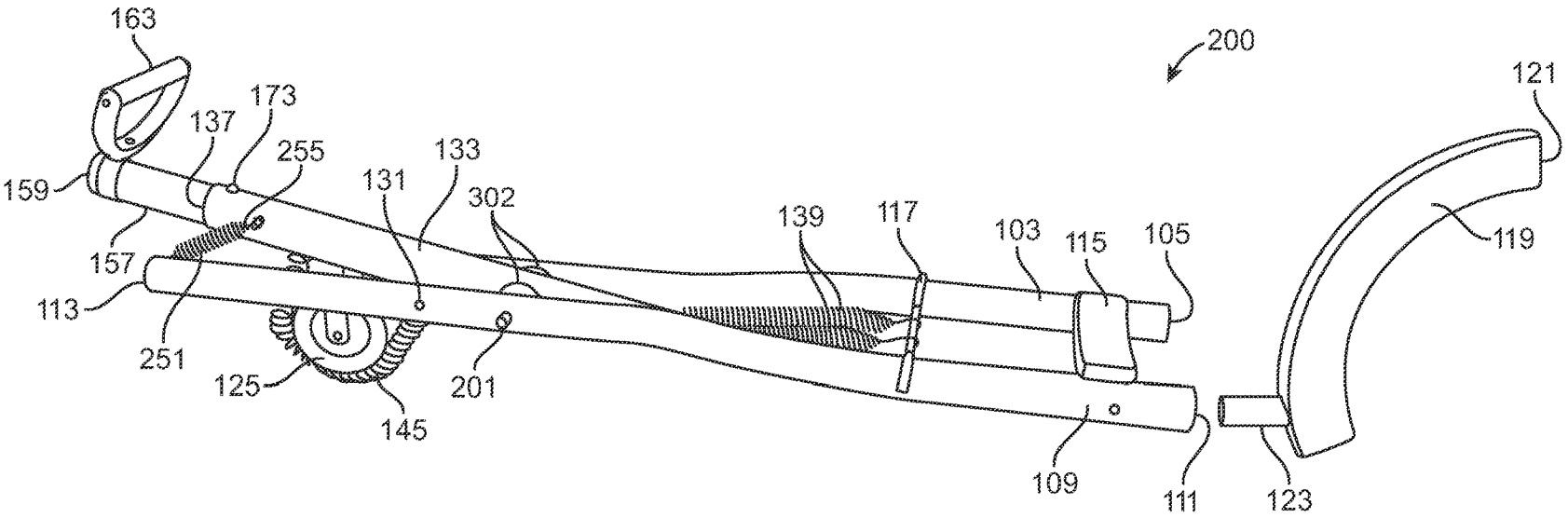
FIG. 4B may depict the embodiment of the portable bicep exercising machine from FIG. 2A, depicted from a left perspective view; wherein the under-arm pad may be removably detached from the second elongate member and removably detached from a first elongate member.
Figure 4C:
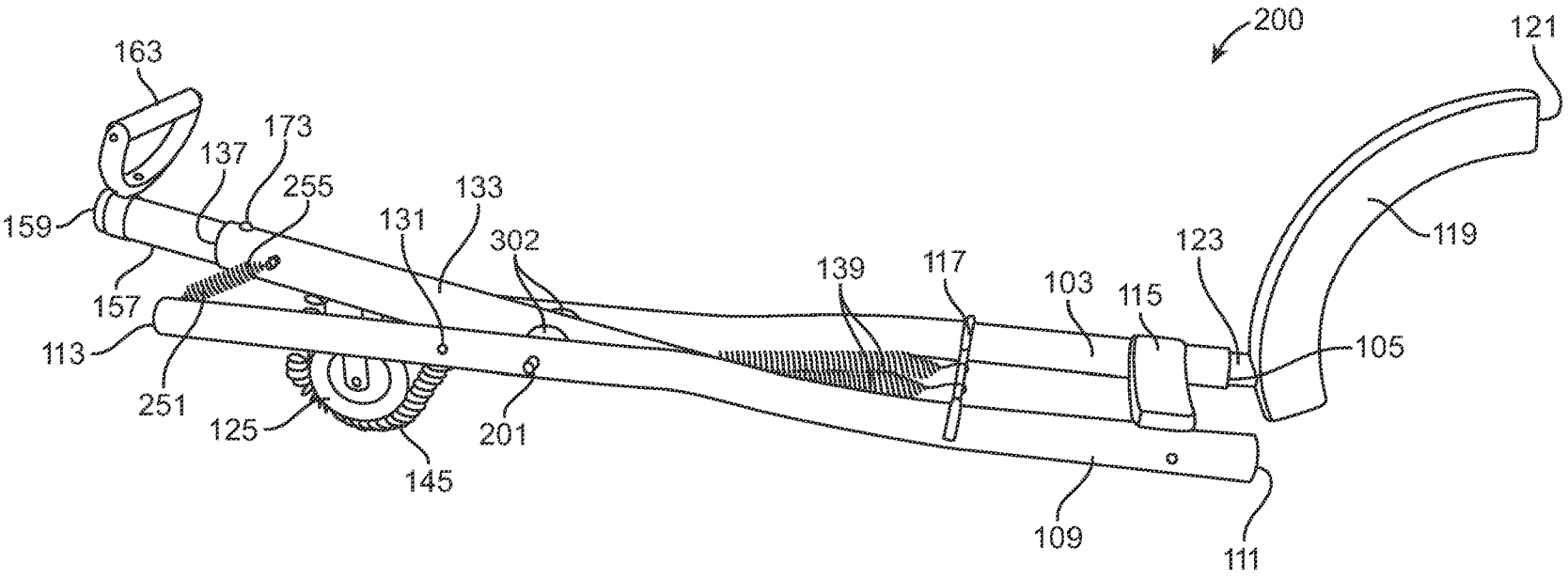
FIG. 4C may depict the embodiment of the portable bicep exercising machine from FIG. 2A, depicted from a left perspective view; wherein the under-arm pad may be removably attached to the first elongate member.

FIG. 4A through and including FIG. 4C may be to demonstrate how under-arm pad 119 may be removably attached to either first elongate member 103 or to second elongate member 109 at lower-pad-terminal-end 123 of under-arm pad 119. This may permit a given portable bicep exercising machine (e.g., 100 and/or 200) to be used on either a right arm or a left arm of user 900. In FIG. 4A, under-arm pad 119 may be removably attached to second elongate member 109. In FIG. 4C, under-arm pad 119 may be removably attached to first elongate member 103. And in FIG. 4B, under-arm pad 119 may be shown removed from both first elongate member 103 and from second elongate member 109.

In some embodiments, portable bicep exercising machine 100 or 200 may comprise under-arm pad 119. See e.g., FIG. 1A and FIG. 2A, respectively. In some embodiments, under-arm pad 119 may comprise upper-pad-terminal-end 121 and lower-pad-terminal-end 123. See e.g., FIG. 2A. In some embodiments, portions of under-arm pad 119 may be padded. In some embodiments, under-arm pad 119 may be removably attachable to a given elongate member (e.g., 103 or 109). See e.g., FIG. 4A, FIG. 4B, and FIG. 4C. In some embodiments, under-arm pad 119 may be removably attachable to first elongate member 103. See e.g., FIG. 4C. In some embodiments, under-arm pad 119 may be removably attachable to second elongate member 109. See e.g., FIG. 4A. In some embodiments, lower-pad-terminal-end 123 may be removably attachable to upper terminal end 105 (see e.g., FIG. 4C) or to second upper terminal end 111 (see e.g., FIG. 4A). Each respective upper terminal end (e.g., 105 and 111) may comprise a hollow receiving-cavity 295. See e.g., FIG. 2D. In some embodiments, receiving-cavity 295 may be sized to removably receive a portion of lower-pad-terminal-end 123, such that this portion and receiving-cavity 295 frictionally engage and couple with each other. This may permit removable attachment of lower-pad-terminal-end 123 to either respective upper terminal end (e.g., 105 and 111). See e.g., FIG. 4A, FIG. 4B, and FIG. 4C. And that interchange may permit portable bicep exercising machine 100 (or 200) to be used for either a left arm or a right arm of user 900.

Figure 5A:
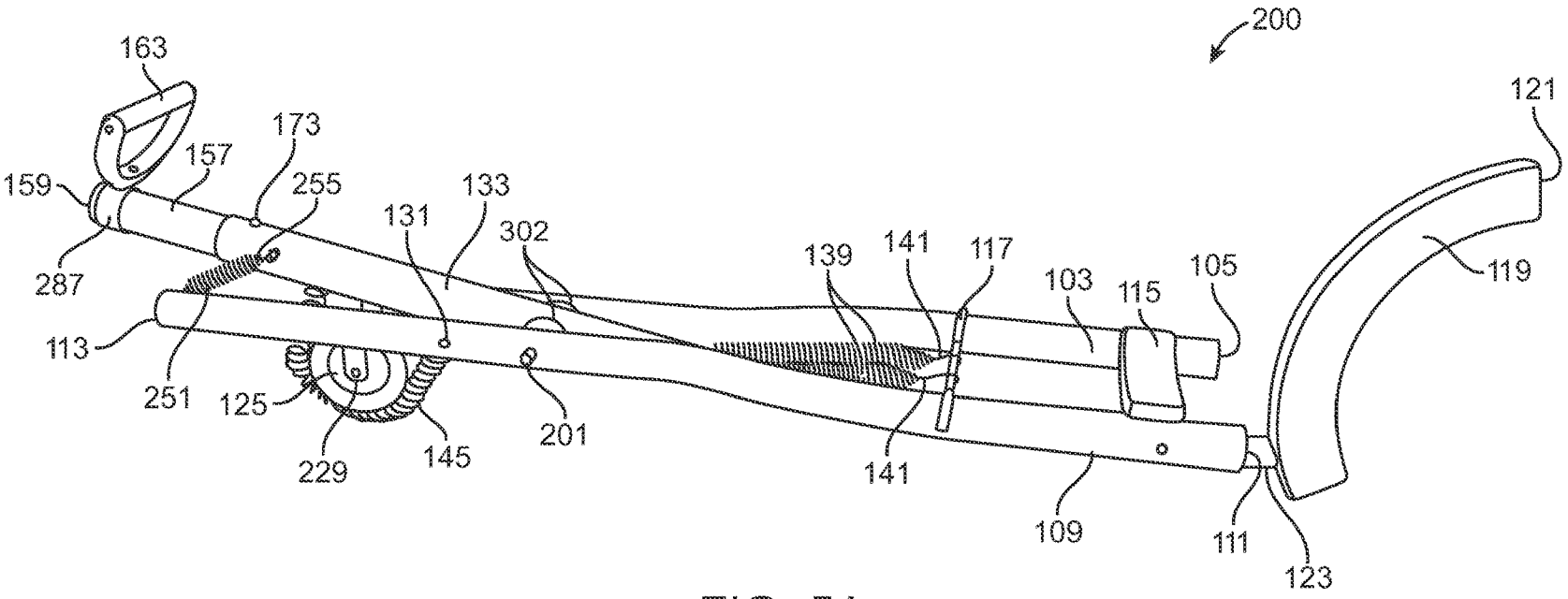
FIG. 5A may depict the embodiment of the portable bicep exercising machine from FIG. 2A, depicted from a left perspective view.
Figure 5B:
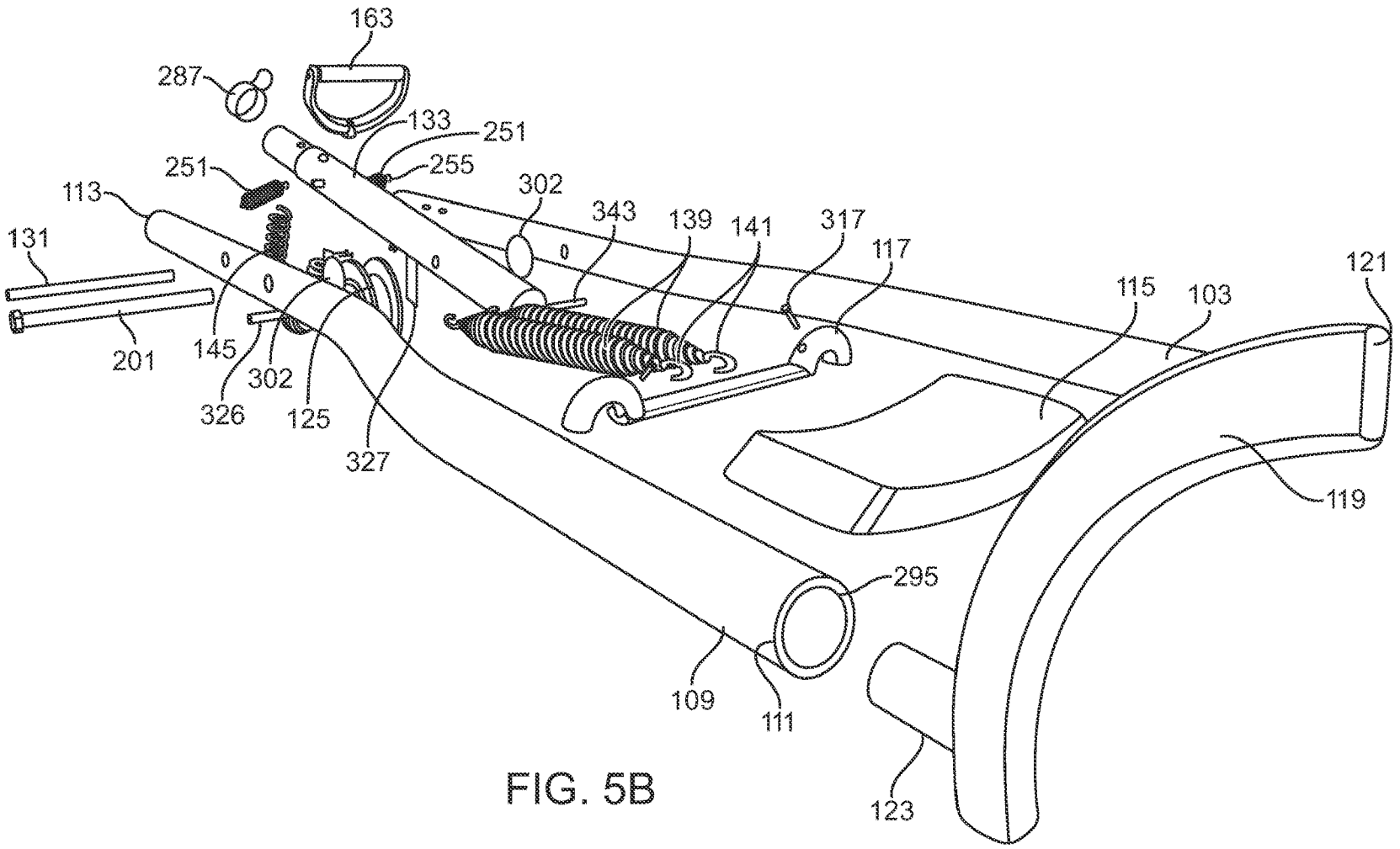
FIG. 5B may depict the embodiment of the portable bicep exercising machine from FIG. 2A, depicted from a left back exploded perspective view.
Figure 5C:
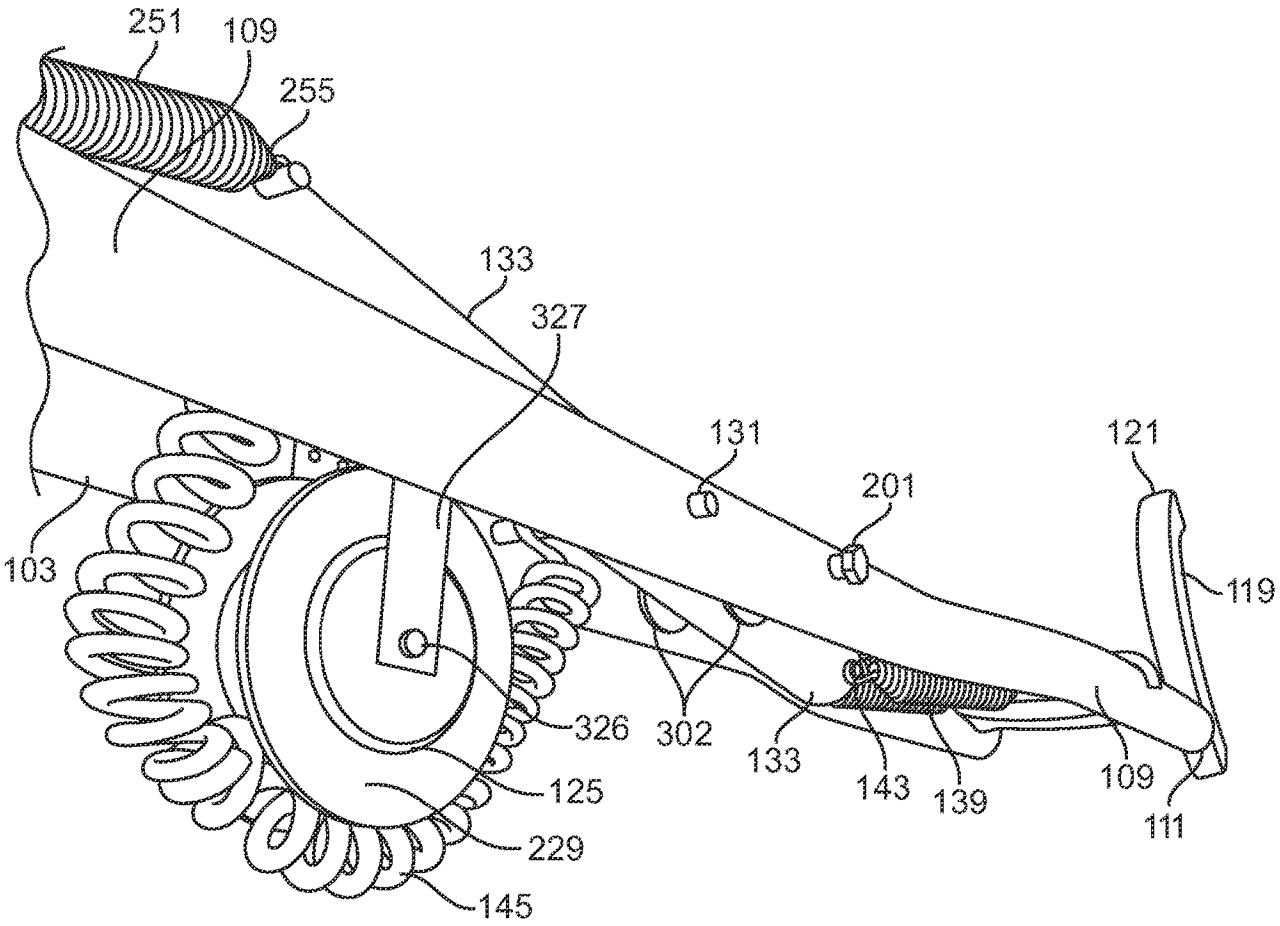
FIG. 5C may depict a portion of the embodiment of the portable bicep exercising machine from FIG. 2A, depicted from a partial left bottom perspective view.
Figure 5D:
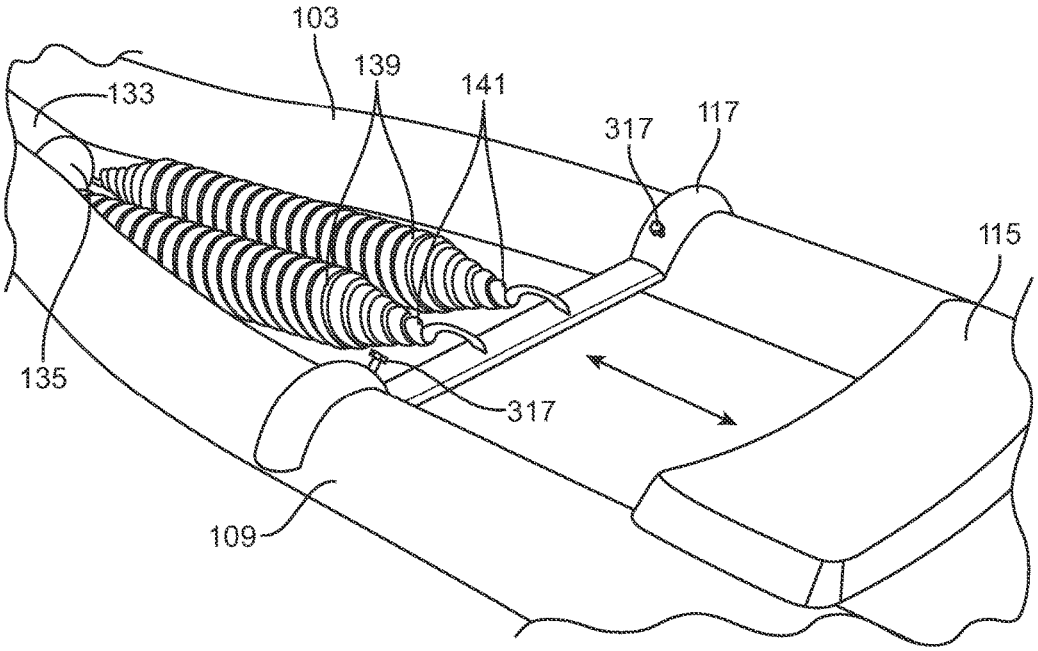
FIG. 5D may depict a portion of the embodiment of the portable bicep exercising machine from FIG. 2A, depicted from a partial left top perspective view.
Figure 5E:
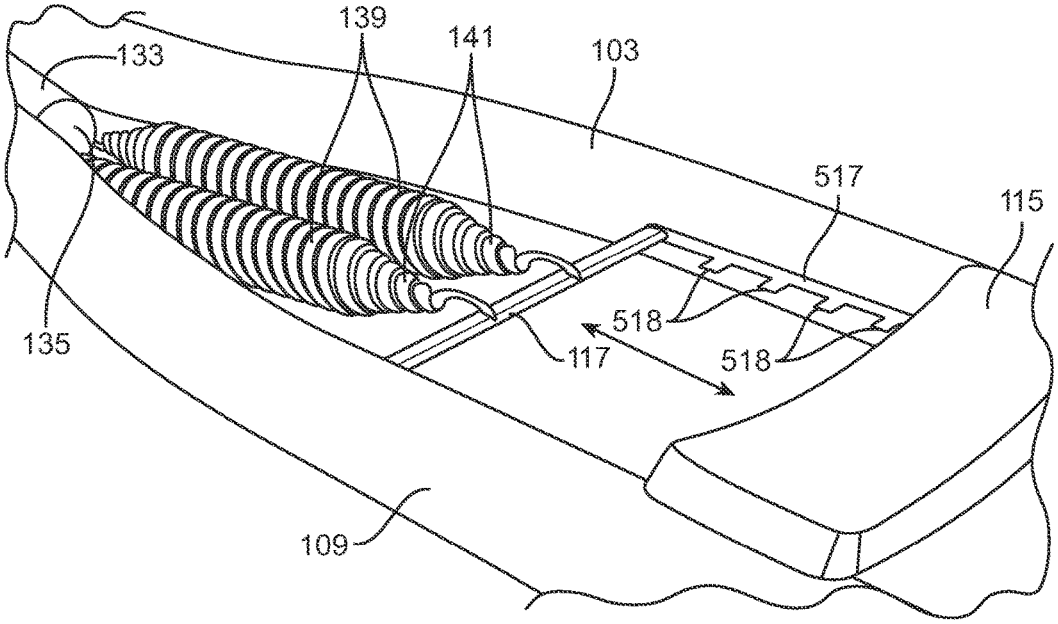
FIG. 5E may depict a portion of the embodiment of the portable bicep exercising machine from FIG. 2A, depicted from a partial left top perspective view.
Figure 5F:
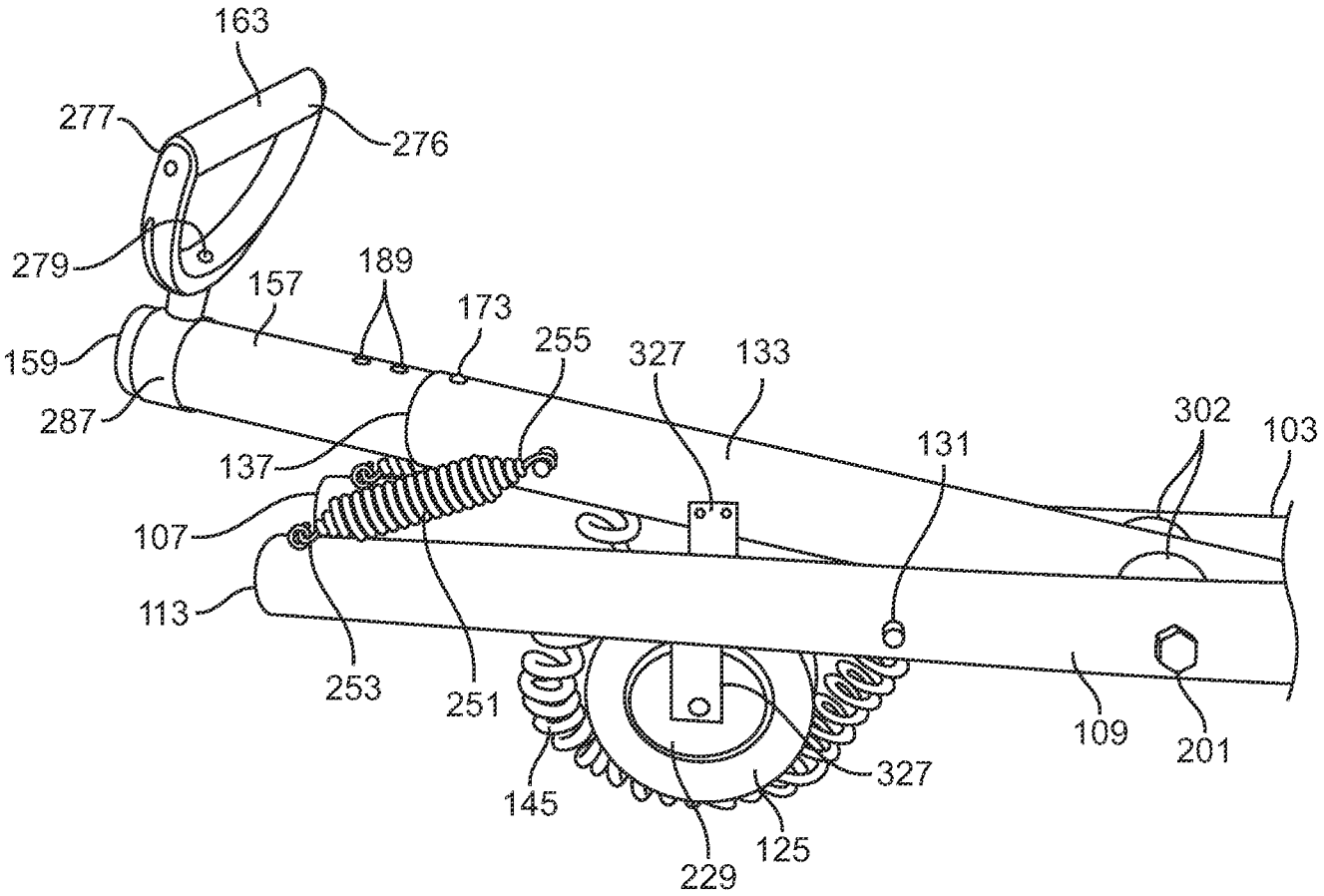
FIG. 5F may depict a portion of the embodiment of the portable bicep exercising machine from FIG. 2A, depicted from a partial left top front perspective view.

FIG. 5A through and including FIG. 5F may demonstrate various tensions means that given embodiments of portable bicep exercising machine (e.g., 100 and/or 200) may employ.

FIG. 5A may depict portable bicep exercising machine 200, depicted from the right side. In FIG. 5A, three different tension means may be depicted: first tension means 139, second tension means 145, and third tension means 251. These three different tension means may be as discussed above.

FIG. 5B may depict portable bicep exercising machine 200, depicted from the rear left exploded view. In FIG. 5B, three different tension means may be depicted: first tension means 139, second tension means 145, and third tension means 251. These three different tension means may be as discussed above.

FIG. 5C may depict portable bicep exercising machine 200, depicted from the left side. In FIG. 5C, three different tension means may be depicted: first tension means 139, second tension means 145, and third tension means 251. These three different tension means may be as discussed above.

FIG. 5D may depict portable bicep exercising machine 200 from a close-up overhead view. FIG. 5D may demonstrate one means for how upper crossbar 117 may be adjusted along the longitude of first elongate member 103 and of second elongate member 109. Varying the location of 117 along the longitude of 103 and of 109 may increase or decrease tension from first tension means 139. To change the location of upper crossbar 117, set screws 317 may be loosened. Then to decrease tension from first tension means 139, upper crossbar 117 may be brought closer to closed terminal end 135. Or to increase tension, upper crossbar 117 may be brought away from closed terminal end 135. Once upper crossbar 117 may be in a desired location, set screws 317 may be tightened.

FIG. 5E may depict portable bicep exercising machine 200 from a close-up overhead view. FIG. 5E may demonstrate one means for how upper crossbar 117 may be adjusted along the longitude of first elongate member 103 and of second elongate member 109. In FIG. 5E, in some embodiments, no set screws 317 need to be employed. Instead, an inside portion of first elongate member 103 and of second elongate member 109 may each comprise a slot 517. Slot 517 may be substantially parallel with the longitude of first elongate member 103 and of second elongate member 109. Opposing terminal ends of upper crossbar 117 may be captured by each respective slot 517. These opposing terminal ends of upper crossbar 117 may be slidable within each respective slot 517. Each slot 517 may comprise a plurality of predetermined stops 518. Each pair of opposing stops 518 may removably lock and capture a respective opposing terminal end of upper crossbar 117. Each such stop 518 may be a cutout in its respective slot 517. Tension from first tension means 139 may naturally keep the opposing terminals ends of 117 in a given pair of opposing stops 518.

FIG. 5F may depict portable bicep exercising machine 200 from a left view. In FIG. 5F, two different tension means may be depicted: second tension means 145 and third tension means 251. These two different tension means may be as discussed above.

Figure 6A:
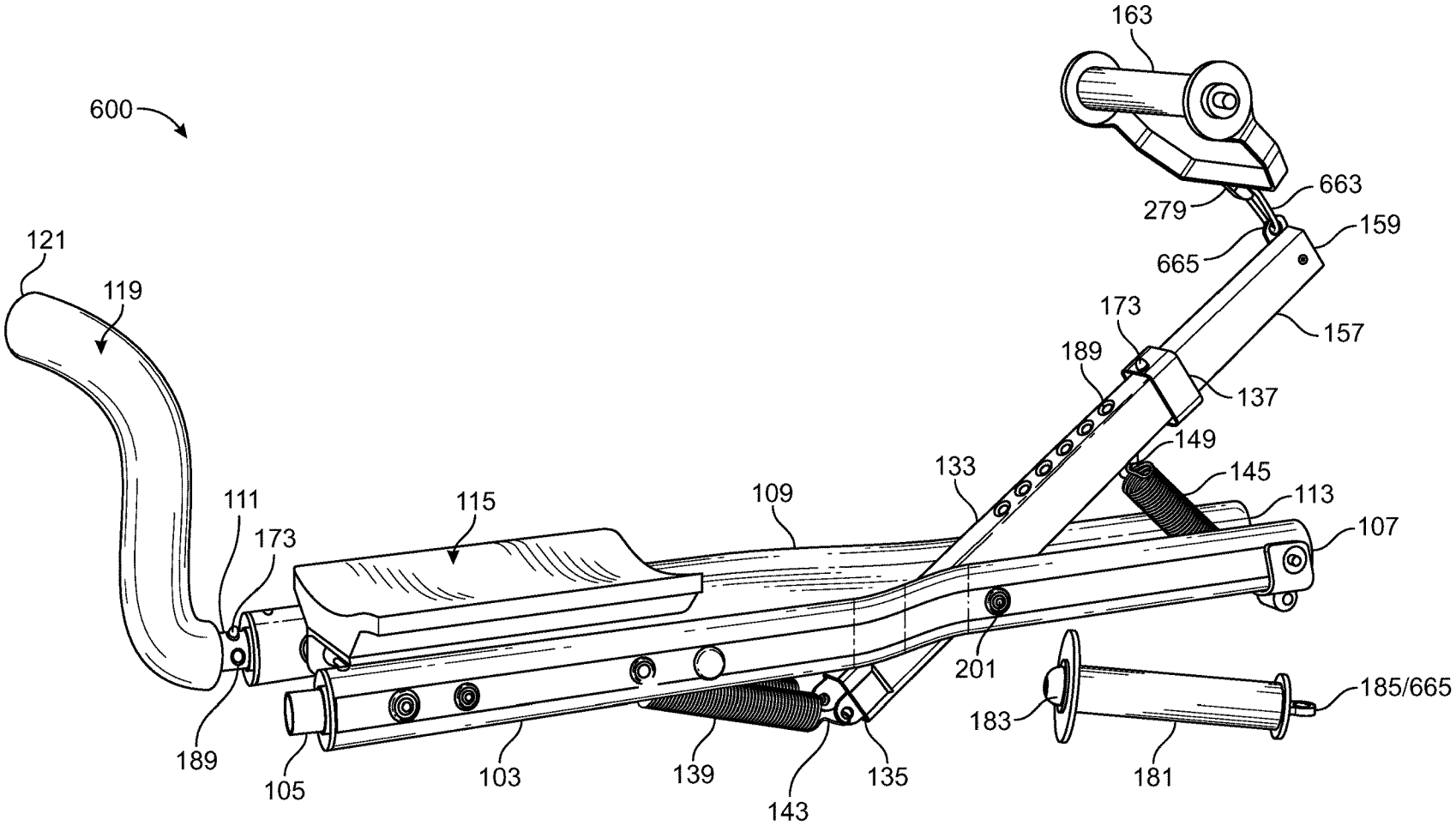
FIG. 6A may depict an embodiment of a portable bicep exercising machine, depicted from a right side perspective view.
Figure 6B:
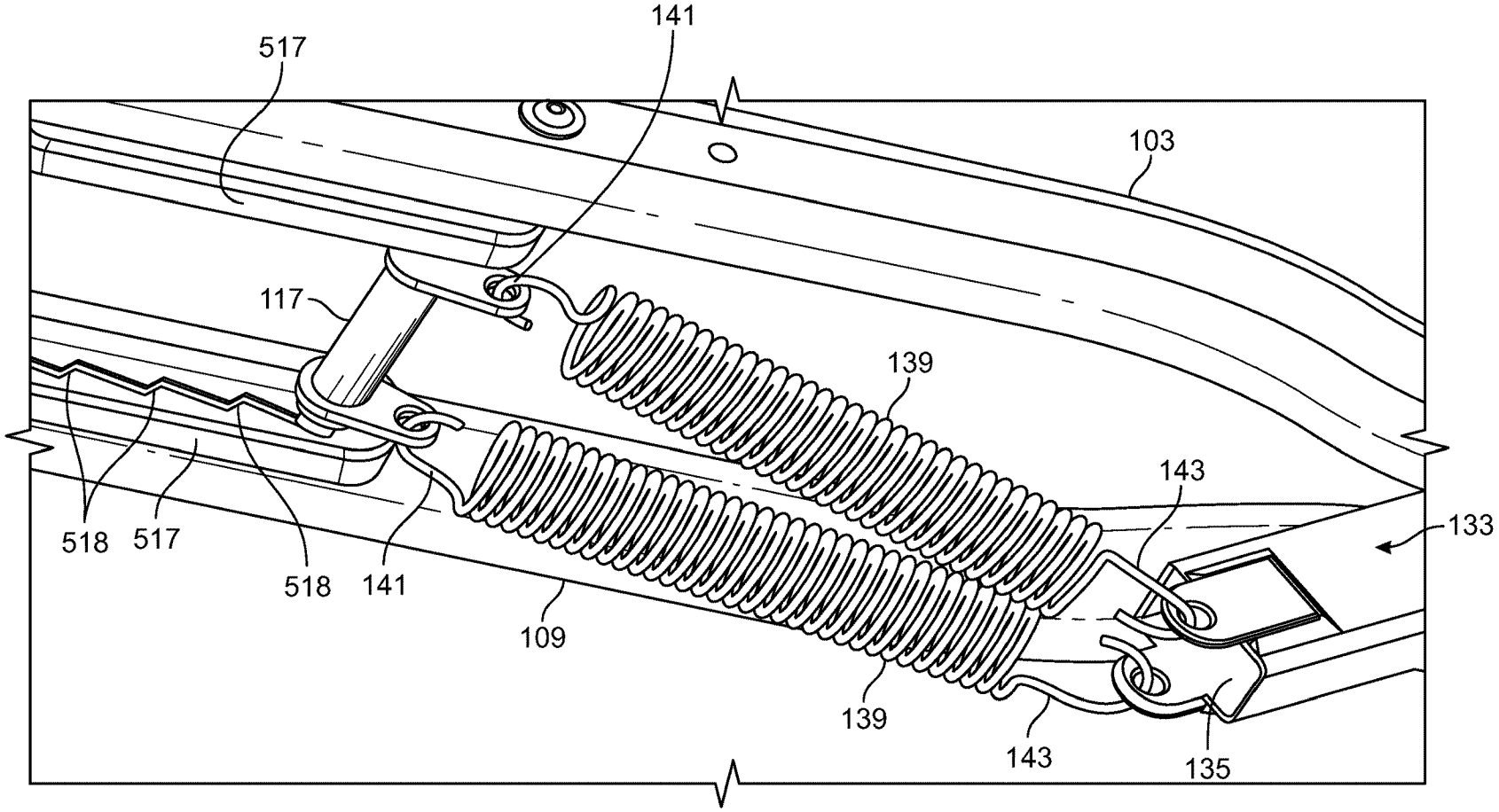
FIG. 6B may depict an underside portion of the portable bicep exercising machine of FIG. 6A.
Figure 6C:
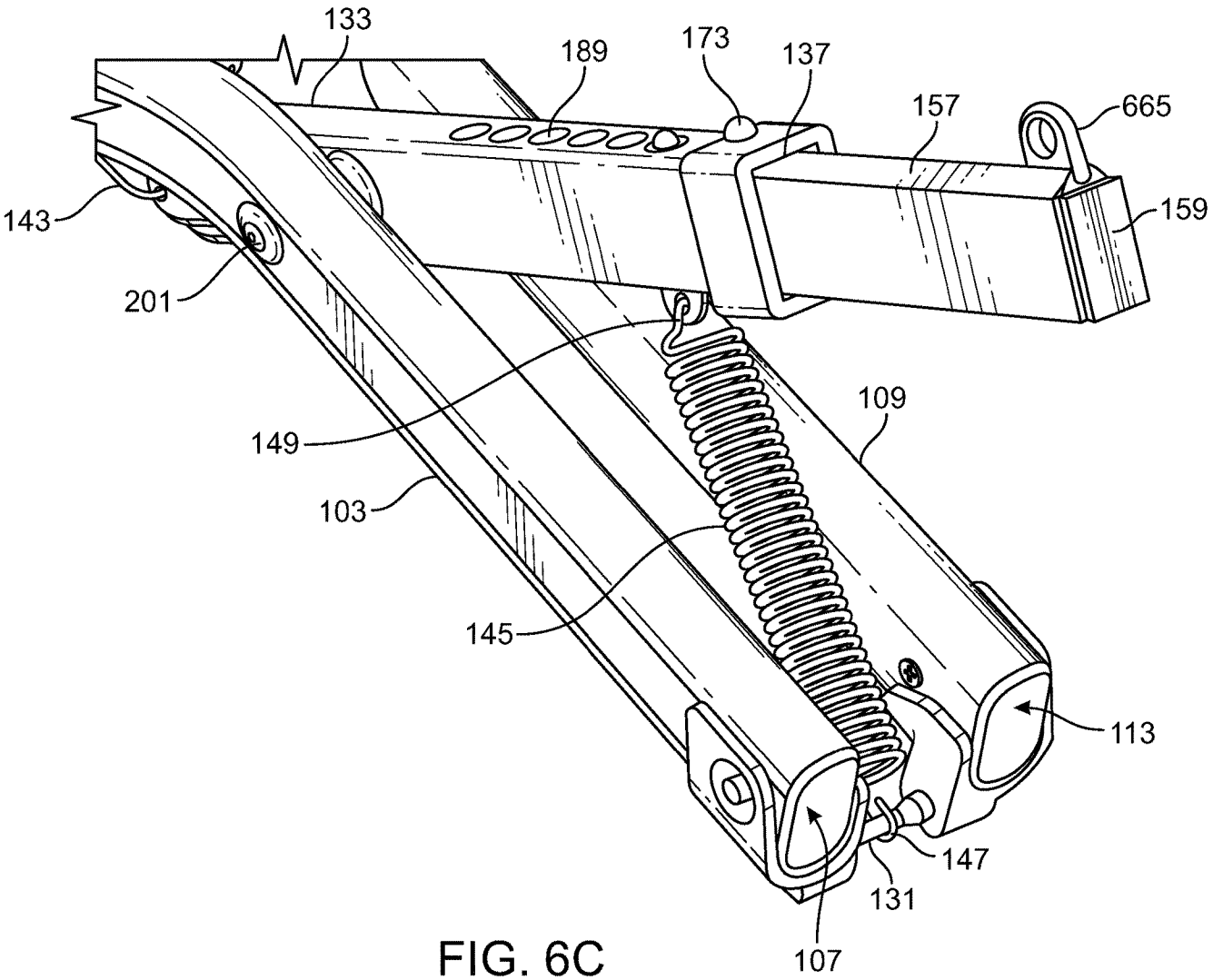
FIG. 6C may depict an end portion of the portable bicep exercising machine of FIG. 6A showing a tension means.
Figure 6D:
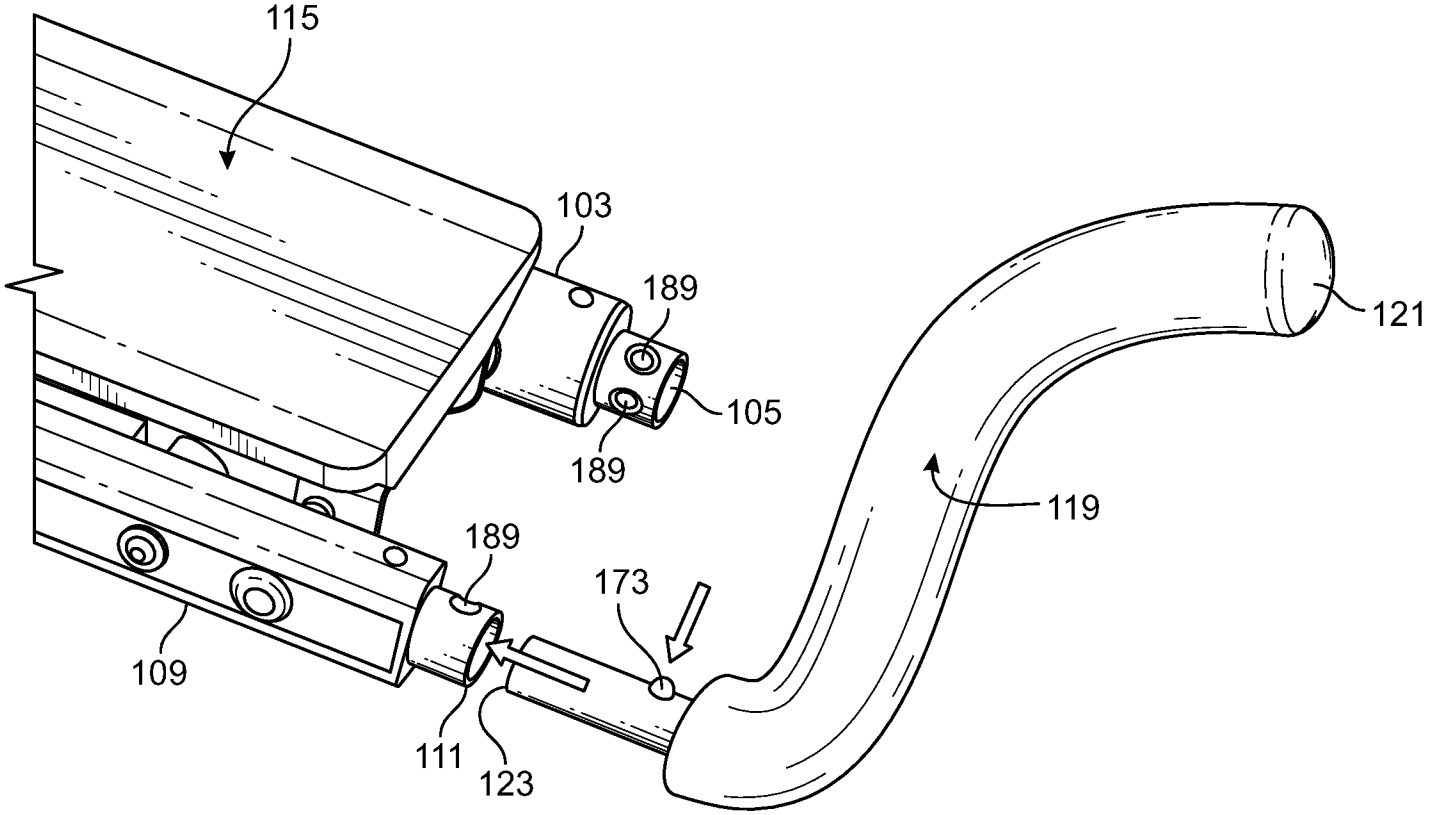
FIG. 6D may depict an end portion of the portable bicep exercising machine of FIG. 6A showing how an under-arm pad may be removable.

FIG. 6A may depict an embodiment of a portable bicep exercising machine 600, depicted from a right side perspective view. FIG. 6B may depict an underside portion of the portable bicep exercising machine 600 of FIG. 6A, showing a tension means, a first tension means 139. FIG. 6C may depict an end portion of the portable bicep exercising machine 600 of FIG. 6A showing a tension means, second tension means 145. FIG. 6D may depict an end portion of the portable bicep exercising machine 600 of FIG. 6A showing how an under-arm pad 119 may be removable from a first elongate member 103 or from a second elongate member 109; which permits portable bicep exercising machine 600 to be usable on a right or left bicep 907 of the user 900.

Discussing FIG. 6A, in some embodiments, portable bicep exercising machine 600 may comprise first elongate member 103, second elongate member 109, pivoting elongate member 133, and at least one tensions means. In some embodiments, first elongate member 103 and second elongate member 109 may be fixedly spaced with respect to each other. In some embodiments, first elongate member 103 and second elongate member 109 may be substantially mirror images of each other. In some embodiments, longitudes of first elongate member 103 and of second elongate member 109 may run in substantially a same direction. In some embodiments, first elongate member 103 and second elongate member 109 may be examples of upper framework. In some embodiments, pivoting elongate member 133 may be disposed between first elongate member 103 and second elongate member 109. In some embodiments, pivoting elongate member 133 may be pivotable with respect to first elongate member 103 and second elongate member 109. In some embodiments, pivoting elongate member 133 may be an example of a lower framework. In some embodiments, at least one tension means may provide resistance to pivoting movement of pivoting elongate member 133. In some embodiments, during use of, the at least one tension means may allow a person (e.g., user 900) to exercise a bicep (e.g., bicep 907) of one arm of that person.

Continuing discussing FIG. 6A, in some embodiments, first elongate member 103 may comprises upper terminal end 105 and disposed opposite lower terminal end 107. In some embodiments, second elongate member 109 may comprise second upper terminal end 111 and disposed opposite second lower terminal end 113.

Continuing discussing FIG. 6A, in some embodiments, portable bicep exercising machine 600 may comprise pivot-axle 201. In some embodiments, pivot-axle 201 may connect pivoting elongate member 133 to first elongate member 103 and to second elongate member 109. In some embodiments, pivot-axle 201 may be a rod functioning as an axle, that permits pivoting elongate member 133 to rotate about pivot-axle 201.

Continuing discussing FIG. 6A, in some embodiments, portable bicep exercising machine 600 may comprise under-arm pad 119. In some embodiments, under-arm pad 119 may be attachable to either upper terminal end 105 or to second upper terminal end 111. In some embodiments, under-arm pad 119 may be removably attachable to either upper terminal end 105 or to second upper terminal end 111. See also, FIG. 6D. In some embodiments, during bicep exercise using portable bicep exercising machine 600, under-arm pad 119 may press against an armpit region of the person (e.g., user 900). In some embodiments, during bicep exercise using portable bicep exercising machine 600, under-arm pad 119 may support the armpit region of the person. In some embodiments, a majority of the exterior of under-arm pad 119 may be padded.

Continuing discussing FIG. 6A and FIG. 6D, in some embodiments, under-arm pad 119 may comprise upper-pad-terminal-end 121 and lower-pad-terminal-end 123. In some embodiments, lower-pad-terminal-end 123 may be attachable to either upper terminal end 105 or to second upper terminal end 111. In some embodiments, lower-pad-terminal-end 123 may be removably attachable to either upper terminal end 105 or to second upper terminal end 111. In some embodiments, lower-pad-terminal-end 123 may be insertable into a cavity of upper terminal end 105 or insertable into a cavity of second upper terminal end 111. In some embodiments, proximate (e.g., within four inches) to lower-pad-terminal-end 123 may be spring-loaded-push-button 173. In some embodiments, proximate (e.g., within three inches) to upper terminal end 105 and proximate (e.g., within three inches) to second upper terminal end 111 may be at least one receiving-hole 189. In some embodiments, a top portion of spring-loaded-push-button 173 may be removably receivable into the at least one receiving-hole 189; which may provide a removable lock communication between lower-pad-terminal-end 123 and upper terminal end 105 or between lower-pad-terminal-end 123 and second upper terminal end 111. See e.g., FIG. 6D and FIG. 6A.

Continuing discussing FIG. 6A, in some embodiments, portable bicep exercising machine 600 may comprise a tricep pad 115. In some embodiments, tricep pad 115 may be in fixed communication with both first elongate member 103 and with second elongate member 109. In some embodiments, tricep pad 115 may removably support at least some portion of a tricep (e.g., tricep 903) of the person during use of the portable bicep exercising machine 600. In some embodiments, a majority of an upper exterior of tricep pad 115 may be padded. In some embodiments, tricep pad 115 may be located closer to upper terminal end 105 and second upper terminal end 111 than to lower terminal end 107 and second lower terminal end 113.

Continuing discussing FIG. 6A, in some embodiments, pivoting elongate member 133, at one end, may comprise open terminal end 137. In some embodiments, disposed opposite of open terminal end 137 on pivoting elongate member 133 may be closed terminal end 135. In some embodiments, portable bicep exercising machine 600 may comprise inner extending elongate member 157. In some embodiments, at least a portion of inner extending elongate member 157 may be insertable into a cavity of open terminal end 137. In some embodiments, inner extending elongate member 157 may be slidable with respect to pivoting elongate member 133; which my facilitate different arms with different lengths for different users 900. In some embodiments, pivoting elongate member 133 proximate (e.g., within 16 inches) to open terminal end 137 may comprises at least one receiving-hole 189. In some embodiments, along a length (longitude) of pivoting elongate member 133 may be a series (plurality) of receiving-holes 189. In some embodiments, located on an exterior surface of inner extending elongate member 157 may be spring-loaded-push-button 173. In some embodiments, the top portion of spring-loaded-push-button 173 may be removably receivable into the at least one receiving-hole 189; which may provide a removable lock communication between inner extending elongate member 157 and pivoting elongate member 133. Thus, the combined length of pivoting elongate member 133 and of inner extending elongate member 157 may be adjusted. See e.g., FIG. 6A.

Continuing discussing FIG. 6A, in some embodiments, inner extending elongate member 157, at one end, may comprise outer terminal end 159 disposed away from the open terminal end 137. In some embodiments, at or proximate (e.g., within three inches) to outer terminal end 159 may be a linkage-receiver 665. In some embodiments, linkage-receiver 665 may be a rigid structure. In some embodiments, linkage-receiver 665 may be a ring like structure. In some embodiments, linkage-receiver 665 may be a closed ring structure. In some embodiments, linkage-receiver 665 may provide a point of attachment for various removable handles (e.g., handle 163 or short elongate member 181) and/or linkages (e.g., a carabiner, d-ring, link, and/or the like). For example, and without limiting the scope of the present invention, in some embodiments, linkage-receiver 665 may anchor and may receive a linkage 663 (e.g., a carabiner, d-ring, link, and/or the like). In some embodiments, linkage 663 may also be removably attachable to handle 163 or to short elongate member 181. In some embodiments, handle 163 or short elongate member 181 may be removably held by a hand (e.g., hand 909) of the person during use of portable bicep exercising machine 600. In some embodiments, one terminal end of short elongate member 181, e.g., lower terminal cap 185 may be configured as a linkage-receiver 665.

Continuing discussing FIG. 6A, in some embodiments, the at least one tension means may be first tension means 139. In some embodiments, first tension means 139 may comprise upper end 141 (see FIG. 6B) and disposed opposite lower end 143 (FIG. 6A and FIG. 6B). In some embodiments, upper end 141 may be attached to an upper crossbar 117 (see FIG. 6B). In some embodiments, upper crossbar 117 may be attached to both first elongate member 103 and second elongate member 109. In some embodiments, upper crossbar 117 may span first elongate member 103 to second elongate member 109. In some embodiments, a longitude of upper crossbar 117 may be substantially perpendicular to longitudes of both first elongate member 103 and of second elongate member 109. In some embodiments, lower end 143 may be attached to closed terminal end 135 at one end of the pivoting elongate member 133. See FIG. 6B and FIG. 6A.

Continuing discussing FIG. 6B and FIG. 6A, in some embodiments, upper crossbar 117 is located closer to upper terminal end 105 and second upper terminal end 111 than to lower terminal end 107 and second lower terminal end 113. In some embodiments, first tension means 139 may be one or more of at least one coil spring and/or at least one resistance band.

Discussing FIG. 6B, in some embodiments, a location of the upper crossbar 117 with respect to longitudes of both first elongate member 103 and second elongate member 109 is adjustable by upper crossbar 117 being received into slots 517 with a plurality of stops 518. In some embodiments, first elongate member 103 may comprise one such slot 517 and second elongate member 109 may comprises another such slot 517. In some embodiments, opposing ends of upper crossbar 117 may be captured (received) in respective slots 517; wherein first elongate member 103 may have such a slot 517 and second elongate member 109 may have such a slot 517. In some embodiments, such paired slots 517 may run in a zig-zag manner, creating a plurality of stops 518; wherein each pair of stops 518 in the paired slots 517, keeps upper crossbar 117 from otherwise translating in the paired slots 517. By this manner, there may be different tension adjustments for first tension means 139.

Discussing FIG. 6A and FIG. 6C, in some embodiments, the at least one tension means may be second tension means 145. In some embodiments, second tension means 145 may comprises first end 147 and disposed opposite second end 149. In some embodiments, first end 147 may be attached to lower crossbar 131. In some embodiments, lower crossbar 131 may be attached to both first elongate member 103 and second elongate member 109. In some embodiments, lower crossbar 131 may span first elongate member 103 to second elongate member 109. In some embodiments, a longitude of lower crossbar 131 may be substantially perpendicular to longitudes of both first elongate member 103 and second elongate member 109. In some embodiments, second end 149 may be attached to pivoting elongate member 133. In some embodiments, lower crossbar 131 may be located closer to lower terminal end 107 and to second lower terminal end 113 than to upper terminal end 105 and to second upper terminal end 111. In some embodiments, lower crossbar 131 may be attached to first elongate member 103 and to second elongate member 109 proximate (e.g., within three inches) to lower terminal end 107 and to second lower terminal end 113. In some embodiments, lower crossbar 131 may provide an anchor location for first end 147. In some embodiments, second tension means 145 may be one or more of at least one coil spring and/or at least one resistance band.

Note, in some embodiments portable bicep exercising machine 600 may not comprise a pulley.

In some embodiments, portable bicep exercising machine 100, 200, and/or 600, and/or at least some of its components may be substantially constructed of one or more thermoplastics suitable for injection molding. For example, and without limiting the scope of the present invention, in some embodiments of portable bicep exercising machine 100, 200, and/or 600, and/or at least some of its components may be substantially constructed of one or more materials of acrylonitrile-butadiene styrene (ABS), polyvinyl chloride (PVC), polycarbonate, nylon, polypropylene, polyethylene (e.g., HDPE), and/or the like.

In some embodiments, portable bicep exercising machine 100, 200, and/or 600, and/or at least some of its components may be substantially constructed of other materials, such as metals. For example, and without limiting the scope of the present invention, in some embodiments of portable bicep exercising machine 100, 200, and/or 600, and/or at least some of its components may be substantially constructed of one or more of aluminum and/or steel.

In some embodiments, the various elongate members (including various crossbars) may be rigid to semi-rigid. In some embodiments, the various elongate members (including various crossbars) may be substantially constructed from aluminum and/or steel tubing. In some embodiments, the various elongate members (including various crossbars) may be substantially constructed from various thermoplastics, including extruded, injection molded, and/or 3D printed.

In some embodiments, the various tension members may be springs, such a coil springs. Such springs may be substantially metal springs. In some embodiments, such coil springs may be substantially covered in protective sheaths. In some embodiments, the various tension members may be resistive elastic members. Such resistive elastic members may be substantially constructed from one or more elastomers, such as rubber (natural and/or synthetic) and/or silicone.

In some embodiments, padded components may comprise one or more foams and a covering. The covering may be a fabric and/or a textile. The fabric or textile covering may be natural and/or synthetic.

Note with respect to the materials of construction, it is not desired nor intended to thereby unnecessarily limit the present invention by reason of such restricted disclosure.

Portable single bicep exercising machines have been described and disclosed. The foregoing description of the various embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A portable biceps exercising machine configured for exercising a biceps muscle of only one arm of a person at a time, wherein the portable biceps exercising machine comprises:

a first elongate member and a second elongate member that are fixedly spaced with respect to each other;

a triceps pad; wherein the triceps pad is in fixed communication with both the first elongate member and the second elongate member; wherein the triceps pad is configured to removably support at least some portion of a triceps muscle of the one arm of the person during use of the portable biceps exercising machine;

a pivoting elongate member that is disposed between the first elongate member and the second elongate member; wherein the pivoting elongate member is pivotable with respect to the first elongate member and the second elongate member;

a member configured to be removably gripped by a hand of the person, wherein the member is in indirect communication with the pivoting elongate member, wherein the member is a handle or is a short elongate member; and at least one tension means that provides resistance to pivoting movement of the pivoting elongate member;

wherein during use of the portable biceps exercising machine: the at least one tension means is configured to allow the person to exercise the biceps muscle of only the one arm of that person; and an entirety of the portable biceps exercising machine is configured to be spaced apart from a lap or a lap region of the person using the portable biceps exercising machine.

2. The portable biceps exercising machine according to claim 1, wherein the first elongate member comprises an upper terminal end and disposed opposite a lower terminal end; and wherein the second elongate member comprises a second upper terminal end and disposed opposite a second lower terminal end.

3. The portable biceps exercising machine according to claim 2, wherein the portable biceps exercising machine further comprises an under-arm pad; wherein the under-arm pad is attachable to either the upper terminal end or to the second upper terminal end; wherein during the biceps muscle exercise, the under-arm pad is configured to press against an armpit region of the person.

4. The portable biceps exercising machine according to claim 3, wherein the under-arm pad comprises an upper-pad-terminal-end and a lower-pad-terminal-end; wherein the lower-pad-terminal-end is attachable to either the upper terminal end or to the second upper terminal end.

5. The portable biceps exercising machine according to claim 4, wherein the lower-pad-terminal-end is insertable into a cavity of the upper terminal end or insertable into a cavity of the second upper terminal end.

6. The portable biceps exercising machine according to claim 5, wherein proximate to the lower-pad-terminal-end is a spring-loaded-push-button; wherein proximate to the upper terminal end and proximate to the second upper terminal end is at least one receiving-hole; wherein a top portion of the spring-loaded-push-button is removably receivable into the at least one receiving-hole providing a removable lock communication between the lower-pad-terminal-end and the upper terminal end or between the lower-pad-terminal-end and the second upper terminal end.

7. The portable biceps exercising machine according to claim 1, wherein the pivoting elongate member at one end comprises an open terminal end; wherein the portable biceps exercising machine further comprises an inner extending elongate member; wherein at least a portion of the inner extending elongate member is insertable into a cavity of the open terminal end; wherein the inner extending elongate member is slidable with respect to the pivoting elongate member.

8. The portable biceps exercising machine according to claim 7, wherein the pivoting elongate member proximate to the open terminal end comprises at least one receiving-hole; wherein located on an exterior surface of the inner extending elongate member is a spring-loaded-push-button; wherein a top portion of the spring-loaded-push-button is removably receivable into the at least one receiving-hole providing a removable lock communication between the inner extending elongate member and the pivoting elongate member.

9. The portable biceps exercising machine according to claim 7, wherein the inner extending elongate member at one end comprises an outer terminal end disposed away from the open terminal end; wherein at or proximate to the outer terminal end is a linkage-receiver; wherein the linkage-receiver anchors and receives a linkage; wherein the linkage is removably attachable to the handle or to the short elongate member; wherein the handle or the short elongate member are configured to be removably held by the hand of the one arm of the person during use of the portable biceps exercising machine.

10. The portable biceps exercising machine according to claim 1, wherein the at least one tension means is a first tension means; wherein the first tension means comprises an upper end and disposed opposite a lower end; wherein the upper end is attached to an upper crossbar; wherein the upper crossbar is attached to both the first elongate member and the second elongate member; wherein the lower end is attached to a closed terminal end at one end of the pivoting elongate member.

11. The portable biceps exercising machine according to claim 10, wherein the first tension means is one or more of at least one coil spring or at least one resistance band.

12. The portable biceps exercising machine according to claim 10, wherein a location of the upper crossbar with respect to longitudes of both the first elongate member and the second elongate member is adjustable by the upper crossbar being received into slots with a plurality of stops; wherein the first elongate member comprises one such slot and the second elongate member comprises another such slot.

13. The portable biceps exercising machine according to claim 10, wherein the triceps pad is always disposed above the first tension means.

14. The portable biceps exercising machine according to claim 1, wherein the at least one tension means comprises a first end and disposed opposite a second end; wherein the first end is attached to a lower crossbar; wherein the lower crossbar is attached to both the first elongate member and the second elongate member; wherein the second end is attached to the pivoting elongate member.

15. The portable biceps exercising machine according to claim 14, wherein the at least one tension means is one or more of at least one coil spring or at least one resistance band.

16. The portable biceps exercising machine according to claim 1, wherein the portable biceps exercising machine further comprises a pivot-axle; wherein the pivot-axle connects the pivoting elongate member to the first elongate member and to the second elongate member.

* * * * *